US007153635B1

(12) United States Patent
Maskasky et al.

(10) Patent No.: US 7,153,635 B1
(45) Date of Patent: Dec. 26, 2006

(54) THERMALLY DEVELOPABLE MATERIALS PROCESSABLE AT LOWER TEMPERATURES

(75) Inventors: Joe E. Maskasky, Rochester, NY (US); Victor P. Scaccia, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/234,711

(22) Filed: Sep. 23, 2005

(51) Int. Cl.
*G03C 5/16* (2006.01)
*G03C 1/00* (2006.01)

(52) U.S. Cl. ..... 430/348; 430/617; 430/618; 430/619; 430/620

(58) Field of Classification Search ..... 430/617–620, 430/348
See application file for complete search history.

(56) References Cited

U.S. PATENT DOCUMENTS 6,531,270 B1 3/2003 Olson et al.
6,531,273 B1 3/2003 Olson et al.
6,586,166 B1 7/2003 Olson et al.
6,605,418 B1 8/2003 Ramsden et al.
6,686,133 B1 2/2004 Friedel

OTHER PUBLICATIONS

U.S. Appl. No. 10/895,727, (D-87894), filed Jul. 21, 2004, titled *Thermographic Materials Processable At Lower Temperatures*, by Maskasky et al.

U.S. Appl. No. 11/025,446, (D-88989), filed Dec. 29, 2004, titled *Aqueous-Based Photothermographic Materials Containing Tetrafluoroborate Salts*, by Simpson et al.

U.S. Appl. No. 11/234,691, (D-89298), filed herewith, titled *Thermographic Material Containing Ionic Liquids*, by Sakizadeh et al.

*Primary Examiner*—Geraldine Letscher
(74) *Attorney, Agent, or Firm*—J. Lanny Tucker

(57) ABSTRACT

Black-and-white direct thermographic materials and photothermographic materials can be processed or developed at lower temperatures because of the incorporation of a quaternary ammonium salt in an amount of at least 0.5 mol % based on total silver in the material.

24 Claims, No Drawings

THERMALLY DEVELOPABLE MATERIALS PROCESSABLE AT LOWER TEMPERATURES

FIELD OF THE INVENTION

This invention relates to thermally developable materials, such as thermographic materials ("direct thermal" materials) and photothermographic materials that can provide images at lower developing temperatures. This invention also relates to methods of imaging using these thermally processable materials.

BACKGROUND OF THE INVENTION

Silver-containing thermographic imaging materials ("direct thermal" materials) are non-photosensitive materials that are used in a recording process wherein images are generated by the direct application of thermal energy. These materials have been known in the art for many years and generally comprise a support having disposed thereon one or more imaging layers comprising (a) a relatively or completely non-photosensitive source of reducible silver ions, (b) a reducing composition (usually including a developer) for the reducible silver ions, (c) a suitable hydrophilic or hydrophobic binder, (d) image toning agents, and (e) development accelerators. Thermographic materials are sometimes called "direct thermal" materials in the art because they are directly imaged by a source of thermal energy without any transfer of the energy or image from another material.

In a typical thermographic construction, the image-forming layers are based on silver salts of long chain fatty acids. Typically, the preferred non-photosensitive reducible silver source is a silver salt of a long chain aliphatic carboxylic acid having from 10 to 30 carbon atoms. The silver salt of behenic acid or mixtures of acids of similar molecular weight are generally used. At elevated temperatures, the silver of the silver carboxylate is reduced by a reducing agent for silver ion such as methyl gallate, hydroquinone, substituted-hydroquinones, hindered phenols, catechols, pyrogallol, ascorbic acid, and ascorbic acid derivatives, whereby an image of elemental silver is formed. Some thermographic constructions are imaged by contacting them with the thermal head of a thermographic recording apparatus such as a thermal printer or thermal facsimile. In such constructions, an anti-stick layer is coated on top of the imaging layer to prevent sticking of the thermographic construction to the thermal head of the apparatus utilized. The resulting thermographic construction is then heated to an elevated temperature, typically in the range of from about 60 to about 225° C., resulting in the formation of an image.

Silver-containing photothermographic materials are used in a recording process wherein an image is formed by imagewise exposure of the photothermographic material to specific electromagnetic radiation (for example, X-radiation, or ultraviolet, visible, or infrared radiation) and developed by the use of thermal energy. These materials, also known as "dry silver" materials, generally comprise a support having coated thereon: (a) a photocatalyst (that is, a photosensitive compound such as silver halide) that upon such exposure provides a latent image in exposed grains that are capable of acting as a catalyst for the subsequent formation of a silver image in a development step, (b) a relatively or completely non-photosensitive source of reducible silver ions, (c) a reducing composition (usually including a developer) for the reducible silver ions, and (d) a hydrophilic or hydrophobic binder. The latent image is then developed by application of thermal energy.

In photothermographic materials, exposure of the photographic silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source is catalytically reduced to form the visible black-and-white negative image while much of the silver halide, generally, remains as silver halide and is not reduced.

In photothermographic materials, the reducing agent for the reducible silver ions, often referred to as a "developer," may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent. In photothermographic materials, upon heating, this reaction occurs preferentially in the regions surrounding the latent image. This reaction produces a negative image of metallic silver having a color that ranges from yellow to deep black depending upon the presence of toning agents and other components in the imaging layer(s).

Problem to be Solved

U.S. Pat. No. 6,686,133 (Friedel) describes the use of mixtures of non-photosensitive silver salts in photothermographic materials. These mixtures allegedly enable lower processing temperatures.

Lower processing temperatures would provide a number of advantages in increased imaging throughput, reduced energy demands, and possibly providing flexibility to use higher temperatures for reduced time. Efforts to provide these advantages have continued for a number of years without significant success.

There remains a need for thermally developable imaging materials (both photothermographic and thermographic recording materials) that can be processed (or developed) at relatively lower temperatures.

SUMMARY OF THE INVENTION

The present invention provides a black-and-white thermally developable imaging material comprising a support having thereon at least one thermally developable imaging layer comprising a binder, and further comprising, in reactive association:

a) a non-photosensitive source of reducible silver ions, b) a reducing agent for the reducible silver ions, and c) a quaternary ammonium salt that is present in an amount of at least 0.5 mol % based on total silver in the material, provided that the quaternary ammonium salt is not a phthalazine or phthalazine derivative.

Further, this invention provides a black-and-white non-light sensitive direct thermographic material comprising a support having thereon at least one non-photosensitive thermally developable imaging layer comprising a binder, and further comprising, in reactive association:

a) a non-photosensitive source of reducible silver ions, b) a reducing agent for the reducible silver ions, and c) a quaternary ammonium salt that is present in an amount of from about 0.5 to about 100 mol % based on total silver in the material, provided that the quaternary ammonium salt is not a phthalazine or phthalazine derivative.

In preferred embodiments, the invention provides a black-and-white, non-photosensitive thermographic material that comprises a transparent polymer support having on only one side thereof, one or more thermally sensitive imaging layers and an outermost non-thermally sensitive protective layer over the one or more thermally sensitive imaging layers, the material comprising a total amount of silver of from about 0.002 to about 0.03 mol/$m^2$, the one or more thermally sensitive imaging layers comprising one or more hydrophobic binders, and in reactive association:

a) a non-photosensitive silver carboxylate salt comprising silver behenate, b) a reducing agent for the non-photosensitive source reducible silver ions comprising a dihydroxybenzene, c) a toning agent, and d) a quaternary ammonium salt that is present in an amount of from about 2 to about 20 mol % based on total silver in the material, the quaternary ammonium salt being one or more of tetramethylammonium acetate, tetraethylammonium acetate, tetraoctylammonium fluoride, tetraethylammonium nitrate, tetramethylammonium formate, di-tetramethylammonium oxalate, tetraethylammonium 2,3-dihydroxybenzoate, tetraethylammonium cyanide, tetramethylammonium hydroxide, tetramethylammonium nitrate, tetra-n-butylammonium acetate, tetrahexylammonium hydrogen sulfate, tetraethylammonium fluoride, 1-ethyl-4-(methoxycarbonyl)pyridinium iodide, 1-ethyl-3-methyl-1H-imidazolium trifluoromethanesulfonate, tetramethylammonium 6-bromohexanoate, tetraethylammonium bromide, tetraethylammonium behenate, and cetyltrimethylammonium hydrogen sulfate.

In addition, the present invention provides a black-and-white photothermographic material comprising a support having thereon at least one photosensitive thermally developable imaging layer comprising a binder, and further comprising, in reactive association:

a) a photosensitive silver halide, b) a non-photosensitive source of reducible silver ions, c) a reducing agent for the reducible silver ions, and d) a quaternary ammonium salt that is present in an amount of at least 0.5 mol % based on total silver in the material, provided that the quaternary ammonium salt is not a phthalazine or phthalazine derivative.

An image-forming method of this invention comprises:

A') imaging the thermally developable material that is a thermographic material with a thermal imaging source to provide a visible image, or A) imagewise exposing the thermally developable material that is a photothermographic material to form a latent image, and B) simultaneously or sequentially, heating the exposed photothermographic material to develop the latent image into a visible image.

The images provided by the method of this invention can be used for medical diagnostic purposes.

We have found that the addition of quaternary ammonium compounds to the imaging composition of thermally developable materials can be used to substantially lower the temperature at which development occurs. It has been known for some time that quaternary ammonium compounds can lower the induction period of development for conventional black-and-white silver halide films developed with solution hydroquinone type developing agent. The widely accepted explanation is that the formal positive charge carried by these quaternary compounds enables the developing agent to penetrate the negative charge barrier at the surface of the silver halide grain. See T. H. James, Ed., *The Theory of the Photographic Process*, Fourth Edition, Eastman Kodak Company, Rochester, N.Y., 1977, p. 301. However, this mechanism is not important for dry thermographic imaging systems since these systems do not rely on development of silver halide grains and significant quantities of water are absent. Surprisingly, we have found that quaternary ammonium compounds lower development temperatures in such materials. The effect can be very large, especially for direct thermographic materials, and it is not just a reduction in development induction time.

Without being bound to a particular mechanism, it is believed that the quaternary ammonium compounds, due to their positive charge, help stabilize anionic developer intermediates important to the development process and otherwise difficult to form in a dry coating (for example, the radical-anion semiquinone).

DETAILED DESCRIPTION OF THE INVENTION

The present invention relates to both black-and-white non-light sensitive direct thermographic and photosensitive photothermographic materials.

The thermally developable materials can be used in black-and-white photothermography and in electronically generated black-and-white hardcopy recording. They can be used in microfilm applications, in radiographic imaging (for example digital medical imaging), X-ray radiography, and in industrial radiography. Furthermore, the absorbance of these materials between 350 and 450 nm is desirably low (less than 0.5), to permit their use in the graphic arts area (for example, imagesetting and phototypesetting), in the manufacture of printing plates, in contact printing, in duplicating ("duping"), and in proofing.

The thermally developable materials are particularly useful for providing images for medical imaging and diagnosis of human or animal subjects in response to infrared, visible, or X-radiation for use in medical diagnosis. Such applications include, but are not limited to, thoracic imaging, mammography, dental imaging, orthopedic imaging, general medical radiography, therapeutic radiography, veterinary radiography, and auto-radiography. Increased sensitivity to X-radiation can be imparted through the use of phosphors. When used with X-radiation, the photothermographic materials may be used in combination with one or more phosphor intensifying screens, with phosphors incorporated within the photothermographic emulsion, or with a combination thereof. Such materials are particularly useful for dental radiography when they are directly imaged by X-radiation. The materials are also useful for non-medical uses of X-radiation such as X-ray lithography and industrial radiography.

The photothermographic materials can be made sensitive to radiation of any suitable wavelength. Thus, in some embodiments, the materials are sensitive at ultraviolet, visible, near infrared, or infrared wavelengths of the electromagnetic spectrum. In these embodiments, the materials are preferably sensitive to radiation greater than 300 nm (such as sensitivity to, from about 300 nm to about 1100 nm).

Increased sensitivity to a particular region of the spectrum is imparted through the use of various sensitizing dyes.

The photothermographic materials are also useful for non-medical uses of visible or X-radiation (such as X-ray lithography and industrial radiography).

In some embodiments of the thermally developable materials, the components needed for imaging can be in one or more imaging or emulsion layers on one side ("frontside") of the support. The layer(s) that contain the photosensitive photocatalyst (such as a photosensitive silver halide) for photothermographic materials or the non-photosensitive source of reducible silver ions, or both, are referred to herein as the emulsion layer(s). In photothermographic materials, the photocatalyst and non-photosensitive source of reducible silver ions are in catalytic proximity and preferably are in the same emulsion layer. Various non-imaging layers can also be disposed on the "backside" (non-emulsion or non-imaging side) of the materials, including, conductive layers, antihalation layer(s), protective layers, antistatic layers, and transport enabling layers.

Various non-imaging layers can also be disposed on the "frontside" or imaging or emulsion side of the support, including primer layers, interlayers, opacifying layers, antistatic layers, antihalation layers, acutance layers, auxiliary layers, and other layers readily apparent to one skilled in the art.

For some preferred embodiments, the thermally developable materials are "double-sided" or "duplitized" and have the same or different emulsion coatings (or imaging layers) on both sides of the support. In such constructions each side can also include one or more primer layers, interlayers, antistatic layers, acutance layers, antihalation layers, auxiliary layers, conductive layers, anti-crossover layers, and other layers readily apparent to one skilled in the art. Preferably, the imaging layers and protective layers are the same on both sides of the support.

Where the materials contain imaging layers on one side of the support only, various non-imaging layers can be disposed on the "backside" (non-emulsion or non-imaging side) of the materials including an outermost slip or protective layer and/or a conductive layer (including "buried" backside conductive layers).

Definitions

As used herein:

In the descriptions of the thermographic materials, "a" or "an" component refers to "at least one" of that component (for example, a quaternary ammonium compound).

Unless otherwise indicated, the terms "thermographic material", "direct thermographic material", "photothermographic material", "thermally developable imaging materials", and "thermally developable materials" are intended to be in reference to materials of the present invention.

"Photothermographic material(s)" means a construction comprising a support and at least one photothermographic emulsion layer or a photothermographic set of emulsion layers wherein the photosensitive silver halide and the source of reducible silver ions are in one layer and the other essential components or desirable additives are distributed, as desired, in the same layer or in an adjacent coated layer. These materials also include multilayer constructions in which one or more imaging components are in different layers, but are in "reactive association." For example, one layer can include the non-photosensitive source of reducible silver ions and another layer can include the reducing agent and/or photosensitive silver halide.

When used in photothermography, the term, "imagewise exposing" or "imagewise exposure" means that the material is imaged using any exposure means that provides a latent image using electromagnetic radiation. This includes, for example, analog exposure where an image is formed by projection onto the photosensitive material as well as digital exposure where the image is formed one pixel at a time such as by modulation of scanning laser radiation.

"Thermographic material(s)" means a construction comprising at least one thermographic emulsion layer or thermally sensitive imaging layer(s) wherein the source of reducible silver ions is in one layer and the other required components or optional additives are distributed, as desired, in the same layer or in an adjacent coated layers, as well as any supports, topcoat layers, image-receiving layers, carrier layers, blocking layers, conductive layers, antihalation layers, subbing or priming layers. These materials also include multilayer constructions in which one or more imaging components are in different layers, but are in "reactive association". Thus, one layer can include the non-photosensitive source of reducible silver ions and another layer can include the reducing agent, but the two reactive components are in reactive association with each other.

When used in thermography, the term, "imagewise exposing" or "imagewise exposure" means that the material is imaged using any means that provides an image using heat. This includes, for example, analog exposure where an image is formed by differential contact heating through a mask using a thermal blanket or infrared heat source, as well as by digital exposure where the image is formed one pixel at a time such as by modulation of thin-film thermal print-heads or by heating with a modulated scanning laser beam.

The thermographic materials are "direct" thermographic materials in which imaging is either "on" or "off" (bimodal), and thermal imaging is carried out in a single "element" containing all of the necessary imaging chemistry. Direct thermal imaging is distinguishable from what is known in the art as thermal transfer imaging (such as dye transfer imaging) in which the image is produced in one element ("donor") and transferred to another element ("receiver") using thermal means.

"Catalytic proximity" or "reactive association" means that the components are in the same layer or in adjacent layers so that they readily come into contact with each other during imaging and development.

The terms "emulsion layer," "imaging layer," "photothermographic emulsion layer", or "thermographic emulsion layer," mean a thermally sensitive layer of a thermographic material or photothermographic material that contains the non-photosensitive source of reducible silver ions and photosensitive silver halide (if present). It can also mean a layer of the thermally developable material that contains, in addition to the non-photosensitive organic silver salt, the quaternary ammonium compounds or other additives. These layers are usually on what is known as the "frontside" of the support.

The slip layer is generally the outermost layer on the imaging side of a direct thermographic material that is in direct contact with the thermal imaging means.

"Photocatalyst" means a photosensitive compound such as silver halide that, upon exposure to radiation, provides a compound that is capable of acting as a catalyst for the subsequent development of the thermally developable material.

Many of the chemical components used herein are provided as a solution. The term "active ingredient" means the amount or the percentage of the desired material contained in a sample. All amounts listed herein are the amount of active ingredient added unless otherwise specified.

"Ultraviolet region of the spectrum" refers to that region of the spectrum less than or equal to 410 nm, and preferably from about 100 nm to about 410 nm. "Visible region of the spectrum" refers to that region of the spectrum of from about 400 nm to about 700 nm. "Infrared region of the spectrum" refers to that region of the spectrum of from about 700 nm to about 1400 nm.

"Non-photosensitive" means not intentionally light sensitive. The direct thermographic materials are non-photosensitive meaning that no photosensitive silver halide(s) has been purposely added.

The sensitometric terms "photospeed," "speed", or "photographic speed" (also known as sensitivity), absorbance, and contrast have conventional definitions known in the imaging arts. The sensitometric term absorbance is another term for optical density (OD).

In photothermographic materials, the term $D_{min}$ (lower case) is considered herein as image density achieved when the photothermographic material is thermally developed without prior exposure to radiation. The term $D_{max}$ (lower case) is the maximum image density achieved in the imaged area of a particular sample after imaging and development. In thermographic materials, $D_{min}$ is considered herein as the image density in the areas with the minimum application of heat by the thermal printhead. In thermographic materials, the term $D_{max}$ is the maximum image density achieved when the thermographic material is thermally imaged with a given amount of thermal energy.

In both photothermographic and thermographic materials, the term $D_{MIN}$ (upper case) is the density of the non-imaged material. In photothermographic materials, the term $D_{MAX}$ (upper case) is the maximum image density achievable when the photothermographic material is exposed and then thermally developed. In thermographic materials, the term $D_{MAX}$ is the maximum image density achievable when the thermographic material is thermally developed. $D_{MAX}$ is also known as "Saturation Density."

"Transparent" means capable of transmitting visible light or imaging radiation without appreciable scattering or absorption.

As used herein, the phrase "silver organic coordinating ligand" refers to an organic molecule capable of forming a bond with a silver atom. Although the compounds so formed are technically silver coordination compounds they are also often referred to as organic silver salts.

The term "duplitized" is used to define thermally developable materials having one or more of the same or different imaging layers disposed on both sides (front and back) of the support.

In the compounds described herein, no particular double bond geometry (for example, cis or trans) is intended by the structures drawn unless otherwise specified. Similarly, in compounds having alternating single and double bonds and localized charges their structures are drawn as a formalism. In reality, both electron and charge delocalization exists throughout the conjugated chain.

As is well understood in this art, for the chemical compounds herein described, substitution is not only tolerated, but is often advisable and various substituents are anticipated on the compounds used in the present invention unless otherwise stated. Thus, when a compound is referred to as "having the structure" of, or as "a derivative" of, a given formula, any substitution that does not alter the bond structure of the formula or the shown atoms within that structure is included within the formula, unless such substitution is specifically excluded by language.

As a means of simplifying the discussion and recitation of certain substituent groups, the term "group" refers to chemical species that may be substituted as well as those that are not so substituted. Thus, the term "alkyl group" is intended to include not only pure hydrocarbon alkyl chains, such as methyl, ethyl, n-propyl, t-butyl, cyclohexyl, iso-octyl, and octadecyl, but also alkyl chains bearing substituents known in the art, such as hydroxyl, alkoxy, phenyl, halogen atoms (F, Cl, Br, and I), cyano, nitro, amino, and carboxy. For example, alkyl group includes ether and thioether groups (for example $CH_3—CH_2—CH_2—O—CH_2—$ and $CH_3—CH_2—CH_2—S—CH_2—$), hydroxyalkyl (such as 1,2-dihydroxyethyl), haloalkyl, nitroalkyl, alkylcarboxy, carboxyalkyl, carboxamido, sulfoalkyl, and other groups readily apparent to one skilled in the art. Substituents that adversely react with other active ingredients, such as very strongly electrophilic or oxidizing substituents, would, of course, be excluded by the ordinarily skilled artisan as not being inert or harmless.

*Research Disclosure* is a publication of Kenneth Mason Publications Ltd., Dudley House, 12 North Street, Emsworth, Hampshire PO10 7DQ England. It is also available from Emsworth Design Inc., 147 West 24th Street, New York, N.Y. 10011.

Other aspects, advantages, and benefits of the present invention are apparent from the detailed description, examples, and claims provided in this application.

The Photocatalyst

As noted above, the photothermographic materials include one or more photocatalysts in the photothermographic emulsion layer(s). Useful photocatalysts are typically photosensitive silver halides such as silver bromide, silver iodide, silver chloride, silver bromoiodide, silver chlorobromoiodide, silver chlorobromide, and others readily apparent to one skilled in the art. Mixtures of silver halides can also be used in any suitable proportion. In addition, silver halides containing up to 100 mol % of iodide (preferably up to about 40 mol %) can also be used alone, or in combination with other silver halides. Silver bromide and silver bromoiodide are more preferred silver halides, with the latter silver halide having up to 40 mol % (preferably up to 30 mol %) silver iodide based on total silver halide.

In some embodiments, higher amounts of iodide may be present in the photosensitive silver halide grains up to the saturation limit of iodide as described in U.S. Patent Application Publication 2004/0053173 (Maskasky et al.).

The silver halide grains may have any crystalline habit or morphology including, but not limited to, cubic, octahedral, tetrahedral, orthorhombic, rhombic, dodecahedral, other polyhedral, tabular, laminar, twinned, or platelet morphologies and may have epitaxial growth of crystals thereon. If desired, a mixture of grains with different morphologies can be employed. Silver halide grains having cubic and tabular morphology (or both) are preferred. More preferably, the silver halide grains are predominantly (at least 50% based on total silver halide) present as tabular grains.

The silver halide grains may have a uniform ratio of halide throughout. They may have a graded halide content, with a continuously varying ratio of, for example, silver bromide and silver iodide, or they may be of the core-shell type, having a discrete core of one or more silver halides, and a discrete shell of one of more different silver halides. Core-shell silver halide grains useful in photothermographic materials and methods of preparing these materials are described for example in U.S. Pat. No. 5,382,504 (Shor et al.) and U.S. Pat. No. 6,770,428 (Maskasky et al.), incorporated herein by reference. Iridium and/or copper doped core-shell and non-core-shell grains are described in U.S. Pat. No. 5,434,043 (Zou et al.) and U.S. Pat. No. 5,939,249 (Zou), both incorporated herein by reference.

In some instances, it may be helpful to prepare the photosensitive silver halide grains in the presence of a hydroxytetraazaindene or an N-heterocyclic compound comprising at least one mercapto group as described in U.S. Pat. No. 6,413,710 (Shor et al.), that is incorporated herein by reference.

The photosensitive silver halide can be added to (or formed within) the emulsion layer(s) in any fashion as long as it is placed in catalytic proximity to the non-photosensitive source of reducible silver ions.

It is preferred that the silver halide grains be preformed and prepared by an ex-situ process, and then be added to and physically mixed with the non-photosensitive source of reducible silver ions.

It is also possible to form the source of reducible silver ions in the presence of ex-situ-prepared silver halide. In this process, the source of reducible silver ions, such as a silver salt of an imino compound, is formed in the presence of the preformed silver halide grains. Co-precipitation of the reducible source of silver ions in the presence of silver halide provides a more intimate mixture of the two materials [see, for example U.S. Pat. No. 3,839,049 (Simons)] to provide a "preformed emulsion."

It is also effective to use an in-situ process in which a halide- or halogen-containing compound is added to an organic silver salt to partially convert the silver of the organic silver salt to silver halide. Inorganic halides (such as zinc bromide, calcium bromide, lithium bromide, or zinc iodide) or an organic halogen-containing compound (such as N-bromosuccinimide or pyridinium hydrobromide perbromide) can be used. The details of such in-situ generation of silver halide are well known and described for example in U.S. Pat. No. 3,457,075 (Morgan et al.).

Additional methods of preparing these silver halide and organic silver salts and manners of blending them are described in *Research Disclosure*, June 1978, item 17029, U.S. Pat. No. 3,700,458 (Lindholm) and U.S. Pat. No. 4,076,539 (Ikenoue et al.), and Japanese Kokai 49-013224, (Fuji), 50-017216 (Fuji), and 51-042529 (Fuji).

In general, the non-tabular silver halide grains used in this invention can vary in average diameter of up to several micrometers (μm) and they usually have an average particle size of from about 0.01 to about 1.5 μm (preferably from about 0.03 to about 1.0 μm, and more preferably from about 0.05 to about 0.8 μm).

The average size of the photosensitive silver halide grains is expressed by the average diameter if the grains are spherical, and by the average of the diameters of equivalent circles for the projected images if the grains are cubic, tabular, or other non-spherical shapes. Representative grain sizing methods are described by in "Particle Size Analysis," ASTM Symposium on Light Microscopy, R. P. Loveland, 1955, pp. 94–122, and in C. E. K. Mees and T. H. James, *The Theory of the Photographic Process*, Third Edition, Macmillan, N.Y., 1966, Chapter 2. Particle size measurements may be expressed in terms of the projected areas of grains or approximations of their diameters. These will provide reasonably accurate results if the grains of interest are substantially uniform in shape.

In most preferred embodiments of this invention, the silver halide grains are provided predominantly (based on at least 50 mol % silver) as tabular silver halide grains that are considered "ultrathin" and have an average thickness of at least 0.02 μm and up to and including 0.10 μm (preferably, an average thickness of at least 0.03 μm and more preferably of at least 0.04 μm, and up to and including 0.08 μm and more preferably up to and including 0.07 μm).

In addition, these ultrathin tabular grains have an equivalent circular diameter (ECD) of at least 0.5 μm (preferably at least 0.75 μm, and more preferably at least 1 μm). The ECD can be up to and including 8 μm (preferably up to and including 6 μm, and more preferably up to and including 4 μm).

The aspect ratio of the useful tabular grains is at least 5:1 (preferably at least 10:1, and more preferably at least 15:1) and generally up to 100:1. The grain size of ultrathin tabular grains may be determined by any of the methods commonly employed in the art for particle size measurement, such as those described above. More details of these tabular grains are provided in U.S. Pat. No. 6,576,410 (Zou et al.), incorporated herein by reference.

The ultrathin tabular silver halide grains can also be doped using one or more of the conventional metal dopants known for this purpose including those described in *Research Disclosure* item 38957, September, 1996 and U.S. Pat. No. 5,503,970 (Olm et al.), incorporated herein by reference. Preferred dopants include iridium (III or IV) and ruthenium (II or III) salts.

Mixtures of both in-situ and ex-situ silver halide grains may be used.

The one or more light-sensitive silver halides used in the photothermographic materials are preferably present in an amount of from about 0.005 to about 0.5 mole (more preferably from about 0.01 to about 0.25 mole, and most preferably from about 0.03 to about 0.15 mole) per mole of non-photosensitive source of reducible silver ions.

Chemical Sensitizers

The photosensitive silver halides used in photothermographic materials can be chemically sensitized using any useful compound that contains sulfur, tellurium, or selenium, or may comprise a compound containing gold, platinum, palladium, ruthenium, rhodium, iridium, or combinations thereof, a reducing agent such as a tin halide or a combination of any of these. The details of these materials are provided for example, in T. H. James, *The Theory of the Photographic Process*, Fourth Edition, Eastman Kodak Company, Rochester, N.Y., 1977, Chapter 5, pp. 149–169. Suitable conventional chemical sensitization procedures and compounds are also described in U.S. Pat. No. 1,623,499 (Sheppard et al.), U.S. Pat. No. 2,399,083 (Waller et al.), U.S. Pat. No. 3,297,447 (McVeigh), U.S. Pat. No. 3,297,446 (Dunn), U.S. Pat. No. 5,049,485 (Deaton), U.S. Pat. No. 5,252,455 (Deaton), U.S. Pat. No. 5,391,727 (Deaton), U.S. Pat. No. 5,912,111 (Lok et al.), U.S. Pat. No. 5,759,761 (Lushington et al.), U.S. Pat. No. 6,296,998 (Eikenberry et al), and U.S. Pat. No. 5,691,127 (Daubendiek et al.), and EP 0 915 371 A1 (Lok et al.), all incorporated herein by reference.

Mercaptotetrazoles and tetraazindenes as described in U.S. Pat. No. 5,691,127 (Daubendiek et al.), incorporated herein by reference, can also be used as suitable addenda for tabular silver halide grains.

Certain substituted or and unsubstituted thiourea compounds can be used as chemical sensitizers including those described in U.S. Pat. No. 6,296,998 (Eikenberry et al.), U.S. Pat. No. 6,322,961 (Lam et al.), U.S. Pat. No. 4,810,626

(Burgmaier et al.), and U.S. Pat. No. 6,368,779 (Lynch et al.), all of the which are incorporated herein by reference.

Still other useful chemical sensitizers include tellurium- and selenium-containing compounds that are described in U.S. Pat. No. 6,699,647 (Lynch et al.), U.S. Pat. No. 5,158,892 (Sasaki et al.), U.S. Pat. No. 5,238,807 (Sasaki et al.), U.S. Pat. No. 5,942,384 (Arai et al.), and U.S. Pat. No. 6,620,577 (Lynch et al.), all of which are incorporated herein by reference.

Noble metal sensitizers for use in the present invention include gold, platinum, palladium and iridium. Gold (+1 or +3) sensitization is particularly preferred, and described in U.S. Pat. No. 5,858,637 (Eshelman et al.) and U.S. Pat. No. 5,759,761 (Lushington et al.). Combinations of gold(III) compounds and either sulfur- or tellurium-containing compounds are useful as chemical sensitizers and are described in U.S. Pat. No. 6,423,481 (Simpson et al.). All of the above references are incorporated herein by reference.

In addition, sulfur-containing compounds can be decomposed on silver halide grains in an oxidizing environment. Examples of such sulfur-containing compounds include sulfur-containing spectral sensitizing dyes described in U.S. Pat. No. 5,891,615 (Winslow et al.) and diphenylphosphine sulfide compounds represented by the Structure (PS) described in U.S. Pat. No. 7,026,105 (Simpson et al.), both of which are incorporated herein by reference.

The chemical sensitizers can be used in making the silver halide emulsions in conventional amounts that generally depend upon the average size of the silver halide grains. Generally, the total amount is at least $10^{-10}$ mole per mole of total silver, and preferably from about $10^{-8}$ to about $10^{-2}$ mole per mole of total silver. The upper limit can vary depending upon the compound(s) used, the level of silver halide, and the average grain size and grain morphology.

Spectral Sensitizers

The photosensitive silver halides used in the photothermographic materials may be spectrally sensitized with one or more spectral sensitizing dyes that are known to enhance silver halide sensitivity to ultraviolet, visible, and/or infrared radiation. Non-limiting examples of spectral sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. They may be added at any stage in chemical finishing of the photothermographic emulsion, but are generally added after chemical sensitization is achieved. In some embodiments, spectral sensitization is desired to a wavelength of from about 300 to about 450 nm, and in preferred embodiments, the spectral sensitization is from about 360 to about 450 nm, and more preferably from about 380 to about 420 nm. A skilled worker would know how to choose the spectral sensitizing dyes best for these embodiments.

Suitable spectral sensitizing dyes such as those described in U.S. Pat. No. 3,719,495 (Lea), U.S. Pat. No. 4,396,712 (Kinoshita et al.), U.S. Pat. No. 4,439,520 (Kofron et al.), U.S. Pat. No. 4,690,883 (Kubodera et al.), U.S. Pat. No. 4,840,882 (Iwagaki et al.), U.S. Pat. No. 5,064,753 (Kohno et al.), U.S. Pat. No. 5,281,515 (Delprato et al.), U.S. Pat. No. 5,393,654 (Burrows et al), U.S. Pat. No. 5,441,866 (Miller et al.), U.S. Pat. No. 5,508,162 (Dankosh), U.S. Pat. No. 5,510,236 (Dankosh), and U.S. Pat. No. 5,541,054 (Miller et al.), and Japanese Kokai 2000-063690 (Tanaka et al.), 2000-112054 (Fukusaka et al.), 2000-273329 (Tanaka et al.), 2001-005145 (Arai), 2001-064527 (Oshiyama et al.), and 2001-154305 (Kita et al.), can be used in the practice of the invention. All of the publications noted above are incorporated herein by reference. Useful spectral sensitizing dyes are also described in *Research Disclosure*, item 308119, Section IV, December 1989. All of the above publications and patents are incorporated herein by reference.

Teachings relating to specific combinations of spectral sensitizing dyes also provided in U.S. Pat. No. 4,581,329 (Sugimoto et al.), U.S. Pat. No. 4,582,786 (Ikeda et al.), U.S. Pat. No. 4,609,621 (Sugimoto et al.), U.S. Pat. No. 4,675,279 (Shuto et al.), U.S. Pat. No. 4,678,741 (Yamada et al.), U.S. Pat. No. 4,720,451 (Shuto et al.), U.S. Pat. No. 4,818,675 (Miyasaka et al.), U.S. Pat. No. 4,945,036 (Arai et al.), and U.S. Pat. No. 4,952,491 (Nishikawa et al.), all of which are incorporated herein by reference.

Also useful are spectral sensitizing dyes that decolorize by the action of light or heat as described in U.S. Pat. No. 4,524,128 (Edwards et al.), and Japanese Kokai 2001-109101 (Adachi), 2001-154305 (Kita et al.), and 2001-183770 (Hanyu et al.), all of which are incorporated herein by reference.

Dyes may also be selected for the purpose of supersensitization to attain much higher sensitivity than the sum of sensitivities that can be achieved by using each dye alone.

An appropriate amount of spectral sensitizing dye added is generally about $10^{-10}$ to $10^{-1}$ mole, and preferably, about $10^{-7}$ to $10^{-2}$ mole per mole of silver halide.

Non-Photosensitive Source of Reducible Silver Ions

The non-photosensitive source of reducible silver ions used in the thermally developable materials can be any non-photosensitive, non-halogen-containing organic silver salt that contains reducible silver (1+) ions. Such compounds are generally silver salts of silver organic coordinating ligands. Preferably, it is an organic silver salt that is comparatively stable to light and forms a silver image when heated to 50° C. or higher in the presence of a reducing agent. Mixtures of these compounds can be used if desired.

Preferred silver salts of organic acids include silver salts of long-chain carboxylic acids are preferred. The chains typically contain 10 to 30, and preferably 15 to 28, carbon atoms. Useful silver salts include a silver salt of an aliphatic carboxylic acid or a silver salt of an aromatic carboxylic acid (such as benzoates). Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Preferably, at least silver behenate is used alone or in mixtures with other silver salts.

Silver salts and di-silver salts of dicarboxylic acids are also useful including such silver salts as 1,10-decanedicarboxylic acid (or dodecanedioic acid) and 1,12-dodecanedicarboxylic acid (or tetradecanedioic acid).

In some embodiments, a highly crystalline silver behenate can be used as part or all of the non-photosensitive sources of reducible silver ions, as described in U.S. Pat. No. 6,096,486 (Emmers et al.) and U.S. Pat. No. 6,159,667 (Emmers et al.), both incorporated herein by reference. Moreover, the silver behenate can be used in its one or more crystallographic phases (such as a mixture of phases I, II and/or III) as described for example in EP 1 158 355A1 (Geuens et al.), incorporated herein by reference.

Other useful but less preferred silver salts include but are not limited to, silver salts of aromatic carboxylic acids and other carboxylic acid group-containing compounds, silver salts of aliphatic carboxylic acids containing a thioether group as described in U.S. Pat. No. 3,330,663 (Weyde et al.), silver carboxylates comprising hydrocarbon chains incorporating ether or thioether linkages, or sterically hindered substitution in the α- (on a hydrocarbon group) or ortho- (on an aromatic group) position, as described in U.S. Pat. No. 5,491,059 (Whitcomb), silver salts of aliphatic, aromatic, or heterocyclic dicarboxylic acids, silver salts of sulfonates as described in U.S. Pat. No. 4,504,575 (Lee), silver salts of sulfosuccinates as described in EP 0 227 141 A1 (Leenders et al.), silver salts of acetylenes as described in U.S. Pat. No. 4,761,361 (Ozaki et al.) and U.S. Pat. No. 4,775,613 (Hirai et al.), silver salts of compounds containing mercapto or thione groups and derivatives thereof (such as those having a heterocyclic nucleus containing 5 or 6 atoms in the ring, at least one of which is a nitrogen atom), as described in U.S. Pat. No. 4,123,274 (Knight et al.) and U.S. Pat. No. 3,785,830 (Sullivan et al.), silver salts of mercapto or thione substituted compounds that do not contain a heterocyclic nucleus, silver salts of compounds containing an imino group (such as silver salts of benzotriazole and substituted derivatives thereof), silver salts of 1,2,4-triazoles or 1-H-tetrazoles as described in U.S. Pat. No. 4,220,709 (deMauriac), and silver salts of imidazoles and imidazole derivatives as described in U.S. Pat. No. 4,260,677 (Winslow et al.), silver triazolates, silver sulfonates, silver sulfosuccinates, and silver acetylides.

Silver salts of nitrogen-containing heterocyclic compounds are also useful including one or more silver salts of heterocyclic compounds containing an imino group. Representative compounds of this type include, but are not limited to, silver salts of benzotriazole and substituted derivatives thereof (for example, silver methylbenzotriazole and silver 5-chlorobenzotriazole), silver salts of 1,2,4-triazoles or 1-H-tetrazoles such as phenylmercaptotetrazole as described in U.S. Pat. No. 4,220,709 (deMauriac), and silver salts of imidazole and imidazole derivatives as described in U.S. Pat. No. 4,260,677 (Winslow et al.). Particularly useful silver salts of this type are the silver salts of benzotriazole, substituted derivatives thereof, or mixtures of two or more of these salts. A silver salt of benzotriazole is most preferred in the photothermographic emulsions and materials.

Particularly useful nitrogen-containing organic silver salts and methods of preparing them are described in U.S. Pat. No. 6,977,139 (Zou et al.) that is incorporated herein by reference. Such silver salts (particularly the silver benzotriazoles) are rod-like in shape and have an average aspect ratio of at least 3:1 and a width index for particle diameter of 1.25 or less. Silver salt particle length is generally less than 1 μm. Also useful are the silver salt-toner co-precipitated nano-crystals that comprise a silver salt of a nitrogen-containing heterocyclic compound containing an imino group, and a silver salt comprising a silver salt of a mercaptotriazole. Such co-precipitated nano-crystals are described in U.S. Pat. No. 7,008,748 (Hasberg et al.). Both of these patent applications are incorporated herein by reference.

The methods used for making silver soap emulsions are well known in the art and are disclosed in *Research Disclosure*, April 1983, item 22812, *Research Disclosure*, October 1983, item 23419, U.S. Pat. No. 3,985,565 (Gabrielsen et al.), and the references cited above.

Non-photosensitive silver salts can also be provided as core-shell silver salts such as those described in U.S. Pat. No. 6,355,408 (Whitcomb et al.), that is incorporated herein by reference, or as silver dimer compounds that comprise two different silver salts as described in U.S. Pat. No. 6,472,131 (Whitcomb), that is also incorporated herein by reference.

Still other useful sources of non-photosensitive reducible silver ions in the practice of this invention are the silver core-shell compounds comprising a primary core comprising one or more photosensitive silver halides, or one or more non-photosensitive inorganic metal salts or non-silver containing organic salts, and a shell at least partially covering the primary core, wherein the shell comprises one or more non-photosensitive silver salts, each of which silver salts comprises a organic silver coordinating ligand. Such compounds are described in U.S. Pat. No. 6,803,177 (Bokhonov et al.) that is incorporated herein by reference.

The non-photosensitive organic silver salts can also be provided in the form of an aqueous nanoparticulate dispersion of silver salt particles (such as silver carboxylate particles). The silver salt particles in such dispersions generally have a weight average particle size of less than 1000 nm when measured by any useful technique such as sedimentation field flow fractionation, photon correlation spectroscopy, or disk centrifugation. Obtaining such small silver salt particles can be achieved using a variety of techniques but generally they are achieved using high-speed milling using a device such as those manufactured by Morehouse-Cowles and Hochmeyer. The details for such milling are well known in the art.

Such dispersions also advantageously include a surface modifier so the silver salt can more readily be incorporated into aqueous-based photothermographic formulations. Useful surface modifiers include, but are not limited to, vinyl polymers having an amino moiety, such as polymers prepared from acrylamide, methacrylamide, or derivatives thereof, as described in U.S. Pat. No. 6,391,537 (Lelental et al.), incorporated herein by reference. A particularly useful surface modifier is dodecylthiopolyacrylamide that can be prepared as described in the noted copending application using the teaching provided by Pavia et al., *Makromolecular Chemie,* 193(9), 1992, pp. 2505–17.

Other useful surface modifiers are phosphoric acid esters, such as mixtures of mono- and diesters of orthophosphoric acid and hydroxy-terminated, oxyethylated long-chain alcohols or oxyethylated alkyl phenols as described for example in U.S. Pat. No. 6,387,611 (Lelental et al.), incorporated herein by reference. Particularly useful phosphoric acid esters are commercially available from several manufacturers under the trademarks or tradenames EMPHOS™ (Witco Corp.), RHODAFAC (Rhone-Poulenc), T-MULZ® (Hacros Organics), and TRYFAC (Henkel Corp./Emery Group).

Such dispersions contain smaller particles and narrower particle size distributions than dispersions that lack such surface modifiers. Particularly useful nanoparticulate dispersions are those comprising silver carboxylates such as silver behenate. These nanoparticulate dispersions can be used in combination with the conventional silver salts described above including silver benzotriazole.

The non-photosensitive, organic silver salts are generally present in an amount of from about 5% to about 70% (more preferably from about 10% to about 50%), based on the total dry weight of the emulsion layers. Stated another way, these organic silver salts are generally present in an amount of from about 0.001 to about 0.2 mol/m$^2$ of the thermally developable material (preferably from about 0.002 to about 0.05 mol/m$^2$).

Further, the amount of total silver in the thermally developable materials is generally from about 0.002 to about 0.05 $mol/m^2$ and preferably from about 0.005 to about 0.05 $mol/m^2$.

Reducing Agents

The reducing agent (or reducing agent composition comprising two or more components) for reducing the reducible silver ions can be any material (preferably an organic material) that can reduce silver (1+) ion to metallic silver. For example, useful reducing agents are organic compounds containing at least one active hydrogen atom linked to an oxygen, nitrogen, or carbon atom. These reducing agents may also be known in the art as "black-and-white" developers or developing agents. Mixtures of reducing agents can be used if desired.

Conventional photographic developers can be used as reducing agents for thermographic materials, including aromatic mono-, di- and tri-hydroxy compounds such as dihydroxybenzenes (including 2,3- and 3,4-dihydroxybenzenes) such as those described in EP 1,270,255A1 (noted above), trihydroxybenzene compounds, alkoxynaphthols, pyrazolidin-3-one type reducing agents, pyrazolin-5-ones, polyhydroxy spiro-bis-indanes, indan-1,3-dione derivatives, hydroxytetrone acids, hydroxytetronimides, hydroxylamine derivatives such as for example those described in U.S. Pat. No. 4,082,901 (Laridon et al.), hydrazine derivatives, hindered phenols, amidoximes, azines, reductones (for example, ascorbic acid and ascorbic acid derivatives), and other materials readily apparent to one skilled in the art.

For photothermographic materials, conventional photographic developers can be used as reducing agents, including aromatic di- and tri-hydroxy compounds (such as hydroquinones, gallatic acid and gallic acid derivatives, catechols, and pyrogallols), aminophenols (for example, N-methylaminophenol), p-phenylenediamines, alkoxynaphthols (for example, 4-methoxy-1-naphthol), pyrazolidin-3-one type reducing agents (for example PHENIDONE®), pyrazolin-5-ones, polyhydroxy spiro-bis-indanes, indan-1,3-dione derivatives, hydroxytetrone acids, hydroxytetronimides, hydroxylamine derivatives such as for example those described in U.S. Pat. No. 4,082,901 (Laridon et al.), hydrazine derivatives, hindered phenols, amidoximes, azines, reductones (for example, ascorbic acid and ascorbic acid derivatives), leuco dyes, and other materials readily apparent to one skilled in the art.

When used with a silver carboxylate silver source in a thermographic material, preferred reducing agents are aromatic di- and tri-hydroxy compounds having at least two hydroxy groups in ortho- or para-relationship on the same aromatic nucleus. Examples are hydroquinone and substituted hydroquinones, catechols, pyrogallol, gallic acid and gallic acid esters, tannic acid, dihydroxybenzenes, and trihydroxybenzenes.

Particularly preferred are reducing catechol-type reducing agents having no more than two hydroxy groups in an ortho-relationship. Preferred catechol-type reducing agents include, for example, catechol, 3-(3,4-dihydroxyphenyl)propionic acid, 2,3-dihydroxy-benzoic acid, 2,3-dihydroxybenzoic acid esters, 3,4-dihydroxy-benzoic acid, and 3,4-dihydroxy-benzoic acid esters.

One particularly preferred class of catechol-type reducing agents are benzene compounds in which the benzene nucleus is substituted by no more than two hydroxy groups which are present in 2,3-position on the nucleus and have in the 1-position of the nucleus a substituent linked to the nucleus by means of a carbonyl group. Compounds of this type include 2,3-dihydroxy-benzoic acid, methyl 2,3-dihydroxy-benzoate, and ethyl 2,3-dihydroxy-benzoate.

Another useful class of catechol-type reducing agents are benzene compounds in which the benzene nucleus is substituted by no more than two hydroxy groups that are present in 3,4-position on the nucleus and have in the 1-position of the nucleus a substituent linked to the nucleus by means of a carbonyl group. Compounds of this type include, for example, 3,4-dihydroxy-benzoic acid, 3-(3,4-dihydroxyphenyl)-propionic acid, 3,4-dihydroxy-benzoic acid esters (such as methyl 3,4-dihydroxy-benzoate, and ethyl 3,4-dihydroxy-benzoate), 3,4-dihydroxy-benzaldehyde, 3,4-dihydroxybenzonitrile, and phenyl-(3,4-dihydroxyphenyl)ketone. Such compounds are described, for example, in U.S. Pat. No. 5,582,953 (Uyttendaele et al.), that is incorporated herein by reference.

Still another particularly useful class of reducing agents includes polyhydroxy spiro-bis-indane compounds that are described in U.S. Pat. No. 3,440,049 (Moede) and U.S. Pat. No. 5,817,598 (Defieuw et al.), both incorporated herein by reference.

In some constructions, "hindered phenol reducing agents" can be used. "Hindered phenol reducing agents" are compounds that contain only one hydroxy group on a given phenyl ring and have at least one additional substituent located ortho to the hydroxy group. Hindered phenol reducing agents may contain more than one hydroxy group as long as each hydroxy group is located on different phenyl rings. Hindered phenol reducing agents include, for example, binaphthols (that is dihydroxybinaphthyls), biphenols (that is dihydroxybiphenyls), bis(hydroxynaphthyl)methanes, bis(hydroxyphenyl)methanes (that is bisphenols), hindered phenols, and hindered naphthols, each of which may be variously substituted. Representative compounds are described in U.S. Pat. No. 3,094,417 (Workman) and U.S. Pat. No. 5,262,295 (Tanaka et al.), both incorporated herein by reference.

In some instances, a reducing agent composition comprises two or more components such as a hindered phenol developer and a co-developer that can be chosen from the various known classes of co-developers. Ternary developer mixtures involving the further addition of contrast enhancing agents are also useful. Such contrast enhancing agents can be chosen from the various classes of reducing agents described below. Useful co-developer reducing agents are as described for example, in U.S. Pat. No. 6,387,605 (Lynch et al.) that is incorporated herein by reference.

In some embodiments, when a silver benzotriazole silver source is used, ascorbic acid reducing agents are useful. An "ascorbic acid" reducing agent (also referred to as a developer or developing agent) means ascorbic acid, complexes, and derivatives thereof. An "ascorbic acid" reducing agent means ascorbic acid, complexes, and derivatives thereof. Ascorbic acid reducing agents are described in a considerable number of publications including U.S. Pat. No. 5,236,816 (Purol et al.) and references cited therein. Useful ascorbic acid developing agents include ascorbic acid and the analogues, isomers and derivatives thereof. Such compounds include, but are not limited to, D- or L-ascorbic acid, sugar-type derivatives thereof (such as sorboascorbic acid, γ-lactoascorbic acid, 6-desoxy-L-ascorbic acid, L-rhamnoascorbic acid, imino-6-desoxy-L-ascorbic acid, glucoascorbic acid, fucoascorbic acid, glucoheptoascorbic acid, maltoascorbic acid, L-arabosascorbic acid), sodium ascorbate, potassium ascorbate, isoascorbic acid (or L-erythroascorbic acid), and salts thereof (such as alkali metal, ammonium or others known in the art), endiol type ascorbic acid, an enaminol type ascorbic acid, a thioenol type ascorbic acid, and an enamin-thiol type ascorbic acid, as described in EP 0 585 792A1 (Passarella et al.), EP 0 573 700A1 (Lingier et al.), EP 0 588 408A1 (Hieronymus et al.), U.S. Pat. No. 5,089,819 (Knapp), U.S. Pat. No. 2,688,549 (James et al.), U.S. Pat. No. 5,278,035 (Knapp), U.S. Pat. No. 5,384,232 (Bishop et al.), U.S. Pat. No. 5,498,511 (Yamashita et al.), and U.S. Pat. No. 5,376,510 (Parker et al.), Japanese Kokai 7-56286 (Toyoda), and *Research Disclosure*, item 37152, March 1995. Mixtures of these developing agents can be used if desired.

Additionally useful reducing agents are esters of ascorbic acid that are described in commonly assigned U.S. Publication 2005/0164136 (Ramsden et al.). Also useful are the solid particle dispersions of certain ascorbic acid esters that are prepared in the presence of a particle growth modifier that are described in commonly assigned U.S. Publication 2006/0051714 (Brick et al.). Both of these patent applications are incorporated herein by reference.

Additional classes of reducing agents that are useful as co-developers are trityl hydrazides and formyl phenyl hydrazides as described in U.S. Pat. No. 5,496,695 (Simpson et al.), 2-substituted malondialdehyde compounds as described in U.S. Pat. No. 5,654,130 (Murray), and 4-substituted isoxazole compounds as described in U.S. Pat. No. 5,705,324 (Murray). Additional co-developers are described in U.S. Pat. No. 6,100,022 (Inoue et al.). All of the patents above are incorporated herein by reference.

Yet another class of co-developers includes substituted acrylonitrile compounds that are described in U.S. Pat. No. 5,635,339 (Murray) and U.S. Pat. No. 5,545,515 (Murray et al.), both incorporated herein by reference.

Additional reducing agents that have been disclosed in dry silver systems including amidoximes, azines, a combination of aliphatic carboxylic acid aryl hydrazides and ascorbic acid, a combination of polyhydroxybenzene and hydroxylamine, a reductone and/or a hydrazine, hydroxamic acids, a combination of azines and sulfonamidophenols, α-cyanophenylacetic acid derivatives, bis-o-naphthols, a combination of bis-o-naphthol and a 1,3-dihydroxybenzene derivative, 5-pyrazolones, reductones, sulfonamidophenol reducing agents, indane-1,3-diones, chromans, 1,4-dihydropyridines, and 3-pyrazolidones.

Yet another useful additional reducing agent are hydroxy-substituted diphenylsulfones such as 4-methyl-3',4',5'-trihydroxy-diphenylsulfone.

The reducing agent (or mixture thereof) described herein is generally present in an amount greater than 0.1 mole per mole of silver and at 1 to 10% (dry weight) of the emulsion layer. In multilayer constructions, if the reducing agent is added to a layer other than an emulsion layer, slightly higher proportions, of from about 2 to 15 weight % may be more desirable. Any co-developers may be present generally in an amount of from about 0.001% to about 1.5% (dry weight) of the emulsion layer coating.

Quaternary Ammonium Salts

The quaternary ammonium salts are generally present in the thermally developable imaging materials in an amount of at least 0.5 mol %, preferably from about 0.5 to about 100 mol %, more preferably from about 1 to about 40, and most preferably from about 2 to about 20, mol %, based on total silver in the material.

These compounds are salts of organoammonium cations that can be represented by the following Structure (I), although the scope of useful compounds is not intended to be limited thereby:

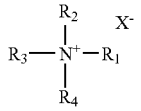

(I)

wherein $R_1$, $R_2$, $R_3$, and $R_4$ are independently aliphatic, heterocyclic, or carbocyclic radicals. Alternatively, any two or more of the radicals can to be combined to form a quaternary ring with the nitrogen atom, except that phthalazine and phthalazine derivatives are not included.

More particularly, $R_1$, $R_2$, $R_3$, and $R_4$ can be independently substituted or unsubstituted alkyl groups having 1 to 24 carbon atoms (such as methyl, ethyl, n-propyl, isopropyl, t-butyl, hexyl, hydroxyethyl, n-octadecyl, benzyl, or methylenecarboalkoxy), substituted or unsubstituted alkene groups having 2 to 24 carbon atoms (such as ethenyl, propenyl, octadecenyl, and limonenyl), substituted or unsubstituted aryl groups having 6 to 10 carbon atoms in the carbocyclic ring (such as phenyl, naphthyl, xylyl, p-methoxyphenyl, p-methylphenyl, m-methoxyphenyl, p-chlorophenyl, methoxycarbonylphenyl), substituted or unsubstituted cycloalkyl groups having 5 to 10 carbon atoms in the carbocyclic ring (such as 1,3- or 1,4-cyclohexyl), or substituted or unsubstituted heterocyclic groups having 5 to 10 carbon, nitrogen, oxygen, and sulfur atoms in the heterocyclic ring (such as pyridyl, morpholinyl, furyl, furfurnyl, benzothiazolyl, and thienyl). Two or more of these noted groups can be linked together with one or more heteroatoms, such as oxy, thio, amino, carbonyl, sulfonyl, and other linking groups known in the art.

Preferably, $R_1$, $R_2$, $R_3$, and $R_4$ are independently substituted or unsubstituted hydrocarbon groups, each having 1 to 24 carbon atoms, and including alkyl, alkenyl, aryl, cycloalkyl, and other hydrocarbon groups. More preferably, these radicals are independently unsubstituted alkyl groups having 1 to 4 carbon atoms.

Alternatively, any two or more of $R_1$, $R_2$, $R_3$, and $R_4$ can be combined to form a substituted or unsubstituted heterocyclic ring with the charged nitrogen atom (other than a phthalazine fused ring system), the ring having 4 to 8 carbon, nitrogen, sulfur, or oxygen atoms in the ring. Such heterocyclic rings include, but are not limited to, substituted or unsubstituted pyridinium, morpholinium, piperidinium, pyrazinium, quinolinium, and imidazolium groups. Other useful substituents for these various groups would be readily apparent to one skilled in the art, and any combinations of the expressly described substituents are also contemplated. Such heterocyclic compounds include, but are not limited to, 1-methylpyridinium acetate and 1,1-dimethylpiperazinium nitrate.

$X^-$ is any suitable organic or inorganic anion. Particularly useful anions are halides (such as fluoride, chloride, bromide, and iodide), sulfate, nitrate, trihaloalkylsulfonates (such as trifluoromethanesulfonate), hydroxide, cyanide, formate, oxalate, acetate, behenate, and other alkyl esters. Some anions can themselves have effects on the system. For example, chloride, bromide, and iodide would lead to the formation of silver halides and could be detrimental in a thermographic material but they may be useful in a photothermographic material. Formate and oxalate could serve as silver ion reducing agents and favorably assist other reducing agents (i.e., developers) that are present. Anions like sulfate and nitrate can reduce the salt solubility in some organic solvents, like methyl ethyl ketone, and thus reduce the ease of incorporating the cation into the imaging formulation. However, they would be easily incorporated in aqueous formulations. Acetate and other low molecular weight organic anions can improve solubility of the cationic salt when used with organic solvents and would thus be desirable. Because many of these cationic salts are at least partially dissolved during the preparation of coating formulations, the final anion associated with the cation is likely different than that initially added with the cation. The final charge neutralizing anion could be any negatively charged species present such as a reducing agent anion, toner molecule anion, or an anion used to make the non-photosensitive source of reducible silver ions (for example, the behenate anion).

Particularly useful quaternary ammonium salts include tetramethylammonium, tetraethylammonium, tetraoctylammonium, and cetyltrimethylammonium salts, including but not limited to, the following compounds (with the understanding that mixtures of these compounds can also be used): tetramethylammonium acetate, tetraethylammonium acetate (and acetate tetrahydrate), di-tetramethylammonium oxalate, tetraethylammonium 2,3-dihydroxybenzoate, tetraethylammonium cyanide, tetramethylammonium hydroxide, tetramethylammonium nitrate, tetra-n-butylammonium acetate, tetrahexylammonium hydrogen sulfate, tetraethylammonium fluoride, 1-ethyl-4-(methoxycarbonyl)pyridinium iodide, 1-ethyl-3-methyl-1H-imidazolium trifluoromethanesulfonate, tetramethylammonium 6-bromohexanoate, tetraethylammonium bromide, tetraoctylammonium fluoride, tetraethylammonium nitrate, tetramethylammonium formate, tetraethylammonium behenate, and cetyltrimethylammonium hydrogen sulfate. By comparing the effectiveness of quaternary ammonium salts at a fixed level and having a non-interacting anion, it was found that the salts having a lower molecular weight cation portion tended to show the largest temperature reduction, perhaps due to cation mobility within the coating while being thermally developed (see TABLE IV below). Thus, to obtain a similar effect, a smaller molar (or weight) amount of tetramethylammonium acetate or tetraethylammonium acetate, for example, would be required than tetrabutylammonium acetate.

The quaternary ammonium salts can be purchased from a number of commercial sources or prepared as described below.

Other Addenda

The thermally developable materials can also contain other additives such as shelf-life stabilizers, antifoggants, contrast enhancers, development accelerators, acutance dyes, post-processing stabilizers or stabilizer precursors, thermal solvents (also known as melt formers), and other image-modifying agents as would be readily apparent to one skilled in the art.

To further control the properties of photothermographic materials, (for example, contrast, $D_{min}$, speed, or fog), it may be preferable to add one or more heteroaromatic mercapto compounds or heteroaromatic disulfide compounds of the formulae Ar—S—$M^1$ and Ar—S—S—Ar, wherein $M^1$ represents a hydrogen atom or an alkali metal atom and Ar represents a heteroaromatic ring or fused heteroaromatic ring containing one or more of nitrogen, sulfur, oxygen, selenium, or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, or quinazolinone. Useful heteroaromatic mercapto compounds are described as supersensitizers for infrared photothermographic materials in EP 0 559 228B1 (Philip Jr. et al.).

Heteroaromatic mercapto compounds are most preferred. Examples of preferred heteroaromatic mercapto compounds are 2-mercaptobenzimidazole, 2-mercapto-5-methylbenzimidazole, 2-mercaptobenzothiazole and 2-mercaptobenzoxazole, and mixtures thereof.

A heteroaromatic mercapto compound is generally present in an emulsion layer in an amount of at least 0.0001 mole (preferably from about 0.001 to about 1.0 mole) per mole of total silver in the emulsion layer.

The photothermographic materials can be further protected against the production of fog and can be stabilized against loss of sensitivity during storage. Suitable antifoggants and stabilizers that can be used alone or in combination include thiazolium salts as described in U.S. Pat. No. 2,131,038 (Brooker) and U.S. Pat. No. 2,694,716 (Allen), azaindenes as described in U.S. Pat. No. 2,886,437 (Piper), triazaindolizines as described in U.S. Pat. No. 2,444,605 (Heimbach), urazoles as described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum, and gold salts as described in U.S. Pat. No. 2,566,263 (Trirelli) and U.S. Pat. No. 2,597,915 (Damshroder).

Additional stabilizers include more polyhalo antifoggants that contain one or more polyhalo substituents including but not limited to, dichloro, dibromo, trichloro, and tribromo groups. The antifoggants can be aliphatic, alicyclic or aromatic compounds, including aromatic heterocyclic and carbocyclic compounds. Particularly useful antifoggants are polyhalo antifoggants, such as those having a —$SO_2C(X')_3$ group wherein X' represents the same or different halogen atoms. Preferred compounds are those having —$SO_2CBr_3$ groups as described in U.S. Pat. No. 3,874,946 (Costa et al.), U.S. Pat. No. 5,374,514 (Kirk et al.), U.S. Pat. No. 5,460,938 (Kirk et al.), and U.S. Pat. No. 5,594,143 (Kirk et al.). Non-limiting examples of such compounds include, 2-tribromomethylsulfonyl quinoline, 2-tribromomethylsulfonyl pyridine, tribromomethylbenzene, and substituted derivatives of these compounds.

Stabilizer precursor compounds capable of releasing stabilizers upon application of heat during development can also be used as described in U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.).

In addition, certain substituted-sulfonyl derivatives of benzotriazoles (for example alkylsulfonylbenzotriazoles and arylsulfonylbenzotriazoles) may be useful as described in U.S. Pat. No. 6,171,767 (Kong et al.).

Other useful antifoggants/stabilizers are described in U.S. Pat. No. 6,083,681 (Lynch et al.). Still other antifoggants are hydrobromic acid salts of heterocyclic compounds (such as pyridinium hydrobromide perbromide) as described in U.S. Pat. No. 5,028,523 (Skoug), benzoyl acid compounds as described in U.S. Pat. No. 4,784,939 (Phan), substituted propenenitrile compounds as described in U.S. Pat. No. 5,686,228 (Murray et al.), silyl blocked compounds as described in U.S. Pat. No. 5,358,843 (Sakizadeh et al.), vinyl sulfones as described in U.S. Pat. No. 6,143,487 (Philip, Jr.

et al.), diisocyanate compounds as described in EP 0 600 586A1 (Philip, Jr. et al.), and tribromomethylketones as described in EP 0 600 587A1 (Oliff et al.).

The photothermographic materials may also include one or more thermal solvents (or melt formers) such as disclosed in U.S. Pat. No. 3,438,776 (Yudelson), U.S. Pat. No. 5,250,386 (Aono et al.), U.S. Pat. No. 5,368,979 (Freedman et al.), U.S. Pat. No. 5,716,772 (Taguchi et al.), and U.S. Pat. No. 6,013,420 (Windender).

It is often advantageous to include a base-release agent or base precursor in photothermographic materials. Representative base-release agents or base precursors include guanidinium compounds and other compounds that are known to release a base but do not adversely affect photographic silver halide materials (such as phenylsulfonyl acetates) as described in U.S. Pat. No. 4,123,274 (Knight et al.).

"Toners" or derivatives thereof that improve the image are highly desirable components of the thermally developable materials. Toners (also known as "toning agents") are compounds that can modify a direct thermographic material is several ways: (1) increasing image density for a given amount of coated silver, (2) increasing the rate of development thereby reducing processing time, and (3) shifting the color of the image from yellowish-orange to brown-black or blue-black. Generally, one or more toners described herein are present in an amount of about 0.01% by weight to about 10%, and more preferably about 0.1% by weight to about 10% by weight, based on the total dry weight of the layer in which it is included. Toners may be incorporated in the emulsion layer(s) or in an adjacent non-imaging layer.

Compounds useful as toners are described in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), and U.S. Pat. No. 5,599,647 (Defieuw et al.) and GB 1,439,478 (AGFA).

Phthalazine and phthalazine derivatives [such as those described in U.S. Pat. No. 6,146,822 (Asanuma et al.), incorporated herein by reference], phthalazinone, and phthalazinone derivatives are particularly useful toners.

Additional useful toners are substituted and unsubstituted mercaptotriazoles as described in U.S. Pat. No. 3,832,186 (Masuda et al.), U.S. Pat. No. 6,165,704 (Miyake et al.), U.S. Pat. No. 5,149,620 (Simpson et al.), and U.S. Pat. No. 6,713,240 (Lynch et al.), and U.S. Published Application 2004-0013984 (Lynch et al.), all of which are incorporated herein by reference.

Also useful are the phthalazine compounds described in U.S. Pat. No. 6,605,418 (Ramsden et al.), the triazine thione compounds described in U.S. Pat. No. 6,703,191 (Lynch et al.), and the heterocyclic disulfide compounds described in U.S. Pat. No. 6,737,227 (Lynch et al.), all of which are incorporated herein by reference.

The photothermographic materials can also include one or more image stabilizing compounds that are usually incorporated in a "backside" layer. Such compounds can include phthalazinone and its derivatives, pyridazine and its derivatives, benzoxazine and benzoxazine derivatives, benzothiazine dione and its derivatives, and quinazoline dione and its derivatives, particularly as described in U.S. Pat. No. 6,599,685 (Kong). Other useful backside image stabilizers include anthracene compounds, coumarin compounds, benzophenone compounds, benzotriazole compounds, naphthalic acid imide compounds, pyrazoline compounds, or compounds described in U.S. Pat. No. 6,465,162 (Kong et al), and GB 1,565,043 (Fuji Photo). All of these patents and patent applications are incorporated herein by reference.

Phosphors are materials that emit infrared, visible, or ultraviolet radiation upon excitation and can be incorporated into the photothermographic materials. Particularly useful phosphors are sensitive to X-radiation and emit radiation primarily in the ultraviolet, near-ultraviolet, or visible regions of the spectrum (that is, from about 100 to about 700 nm). An intrinsic phosphor is a material that is naturally (that is, intrinsically) phosphorescent. An "activated" phosphor is one composed of a basic material that may or may not be an intrinsic phosphor, to which one or more dopant(s) has been intentionally added. These dopants or activators "activate" the phosphor and cause it to emit ultraviolet or visible radiation. Multiple dopants may be used and thus the phosphor would include both "activators" and "co-activators."

Any conventional or useful phosphor can be used, singly or in mixtures. For example, useful phosphors are described in numerous references relating to fluorescent intensifying screens as well as U.S. Pat. No. 6,440,649 (Simpson et al.) and U.S. Pat. No. 6,573,033 (Simpson et al.) that are directed to photothermographic materials, both of which references are incorporated herein.

Some particularly useful phosphors are primarily "activated" phosphors known as phosphate phosphors and borate phosphors. Examples of these phosphors are rare earth phosphates, yttrium phosphates, strontium phosphates, or strontium fluoroborates (including cerium activated rare earth or yttrium phosphates, or europium activated strontium fluoroborates) as described in commonly assigned U.S. Publication 2005/0233269 (Simpson et al.).

The one or more phosphors can be present in the photothermographic materials in an amount of at least 0.1 mole per mole, and preferably from about 0.5 to about 20 mole, per mole of total silver in the photothermographic material. As noted above, generally, the amount of total silver is at least 0.002 mol/m$^2$. While the phosphors can be incorporated into any imaging layer on one or both sides of the support, it is preferred that they be in the same layer(s) as the photosensitive silver halide(s) on one or both sides of the support.

The thermographic materials may also include one or more polycarboxylic acids and/or anhydrides thereof that are in thermal working relationship with the sources of reducible silver ions. Such polycarboxylic acids can be substituted or unsubstituted aliphatic or aromatic compounds. They can be used in anhydride or partially esterified form as long as two free carboxylic acids remain in the molecule. Useful polycarboxylic acids are described for example in U.S. Pat. No. 6,096,486 (noted above).

Binders

The photosensitive silver halide (if present), the non-photosensitive organic silver salt, the reducing agent, quaternary ammonium salt, and any other additives used in the present invention are generally mixed with one or more binders to form a coating formulation.

In some embodiments, the binders are predominantly (at least 50% by weight of total binders) hydrophilic in nature and aqueous solvent-based formulations are used to prepare and coat aqueous-based thermally developable materials. Mixtures of hydrophilic binders can also be used.

Examples of useful hydrophilic binders that can be used include proteins and protein derivatives, gelatin and gelatin-like derivatives (hardened or unhardened), cellulosic materials, acrylamide/methacrylamide polymers, acrylic/methacrylic polymers polyvinyl pyrrolidones, polyvinyl alcohols, poly(vinyl lactams), polymers of sulfoalkyl acrylate or methacrylates, hydrolyzed polyvinyl acetates, polyacrylamides, polysaccharides, and other synthetic or naturally occurring vehicles commonly known for use in aqueous-based imaging emulsions.

Water-dispersible binders including water-dispersible polymer latexes can also be used in the aqueous-based formulations used to prepared aqueous-based thermally developable materials. Such materials are well known in the art including U.S. Pat. No. 6,096,486 (noted above).

In preferred embodiments, the binders are predominantly (at least 50 weight % of total binder weight) hydrophobic in nature and organic-solvents formulations are used to prepare and coat organic solvent-based thermally developable materials. Examples of useful hydrophobic binders include polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral and polyvinyl formal), cellulose ester polymers, and vinyl copolymers (such as polyvinyl acetate and polyvinyl chloride) are preferred. Particularly suitable binders are polyvinyl butyral resins that are available as BUTVAR® B79 (Solutia, Inc.) and PIOLOFORM® BS-18 or PIOLOFORM® BL-16 (Wacker Chemical Company) and cellulose ester polymers.

The polymer binder(s) is used in an amount sufficient to carry the components dispersed therein. Generally, one or more binders are used at a level of about 10% by weight to about 90% by weight (more preferably at a level of about 20% by weight to about 70% by weight) based on the total dry weight of the layer in which it is included.

Support Materials

The thermally developable materials comprise a polymeric support that is preferably a flexible, transparent film that has any desired thickness and is composed of one or more polymeric materials, depending upon their use. The supports are generally transparent (especially if the material is used as a photomask) or at least translucent, but in some instances, opaque supports may be useful. They are required to exhibit dimensional stability during thermal imaging and development and to have suitable adhesive properties with overlying layers. Useful polymeric materials for making such supports include polyesters, cellulose acetate and other cellulose esters, polyvinyl acetal, polyolefins, polycarbonates, and polystyrenes. Preferred supports are composed of polyesters and polycarbonates.

Support materials can contain various colorants, pigments, and antihalation or acutance dyes if desired. For example, the support can contain conventional blue dyes that differ in absorbance from colorants in the various frontside or backside layers as described in U.S. Pat. No. 6,248,442 (Van Achere et al.). Support materials may be treated using conventional procedures (such as corona discharge) to improve adhesion of overlying layers, or subbing or other adhesion-promoting layers can be used, or treated or annealed to promote dimensional stability.

The thermally developable materials (especially thermographic materials) preferably have an outermost slip or protective layer on at least the imaging side of the support comprising useful components such as one or more specific lubricants and/or matting agents that are known in the art. The matting agents can be composed of any useful material and may have a size in relation to the slip layer thickness that enables them to protrude through the outer surface of the conductive layer, as described for example, in U.S. Pat. No. 5,536,696 (Horsten et al.). Useful combinations of lubricants are described in commonly assigned U.S. Publication 2005/0164881 (Kenney et al.)

Formulations and Constructions

An organic solvent-based formulation for emulsion layer(s) can be prepared by dissolving and dispersing a hydrophobic binder, the photosensitive silver halide (if present), the organic silver salt, the reducing agent, quaternary ammonium salt, and any optional addenda in an organic solvent, such as toluene, 2-butanone (methyl ethyl ketone), acetone, or tetrahydrofuran (or mixtures thereof). Alternatively if an aqueous-based formulation is used, a similar dispersion is made with a hydrophilic or water-dispersible binder in an aqueous solvent that comprises at least 50 volume % water. Some of the components may not be water-soluble and thus may need to be dispersed in organic solvents that are miscible with the solvent used to make the formulation.

The thermally developable materials can be constructed of one or more layers on the imaging side of the support. Two-layer materials would usually include a single imaging layer and an outermost protective layer, although two imaging layers could be used without an outermost protective layer. The single imaging layer would contain all of the components needed for imaging as well as components such as toning agents, development accelerators, thermal solvents, coating aids, and other additives.

Thermally developable materials can contain plasticizers and lubricants such as poly(alcohols) and diols as described in U.S. Pat. No. 2,960,404 (Milton et al.), fatty acids or esters as described in U.S. Pat. No. 2,588,765 (Robijns) and U.S. Pat. No. 3,121,060 (Duane), and silicone resins as described in GB 955,061 (DuPont). The materials can also contain inorganic and organic matting agents as described in U.S. Pat. No. 2,992,101 (Jelley et al.) and U.S. Pat. No. 2,701,245 (Lynn). Polymeric fluorinated surfactants may also be useful in one or more layers as described in U.S. Pat. No. 5,468,603 (Kub).

U.S. Pat. No. 6,436,616 (Geisler et al.), incorporated herein by reference, describes various means of modifying photothermographic materials to reduce what is known as the "woodgrain" effect, or uneven optical density.

Layers to promote adhesion of one layer to another are also known, as described in U.S. Pat. No. 5,891,610 (Bauer et al.), U.S. Pat. No. 5,804,365 (Bauer et al.), and U.S. Pat. No. 4,741,992 (Przezdziecki). Adhesion can also be promoted using specific polymeric adhesive materials as described in U.S. Pat. No. 5,928,857 (Geisler et al.).

Layers to reduce emissions from the material may also be present, including the polymeric barrier layers described in U.S. Pat. No. 6,352,819 (Kenney et al.), U.S. Pat. No. 6,352,820 (Bauer et al.), U.S. Pat. No. 6,420,102 (Bauer et al.), U.S. Pat. No. 6,667,148 (Rao et al.), and U.S. Pat. No. 6,746,831 (Hunt), all incorporated herein by reference.

Mottle and other surface anomalies can be reduced by incorporation of a fluorinated polymer as described in U.S. Pat. No. 5,532,121 (Yonkoski et al.) or by using particular drying techniques as described, for example in U.S. Pat. No. 5,621,983 (Ludemann et al.).

The thermally developable materials generally include a conductive layer on one or both sides of the support, and more preferably on the backside of the support. Various conductive materials are known in the art such as soluble salts, evaporated metal layers, or ionic polymers as described in U.S. Pat. No. 2,861,056 (Minsk) and U.S. Pat. No. 3,206,312 (Sterman et al.), insoluble inorganic salts as described in U.S. Pat. No. 3,428,451 (Trevoy), electroconductive underlayers as described in U.S. Pat. No. 5,310,640 (Markin et al.), and electrically-conductive metal-containing particles dispersed in a polymeric binder as described in EP 0 678 776A1 (Melpolder et al.). In addition, fluorochemicals such as Fluorad® FC-135 (3M Corporation), ZONYL® FSN (E. I. DuPont de Nemours & Co.), as well as those described in U.S. Pat. No. 5,674,671 (Brandon et al.), U.S. Pat. No. 6,287,754 (Melpolder et al.), U.S. Pat. No. 4,975,363 (Cavallo et al.), U.S. Pat. No. 6,171,707 (Gomez et al.), U.S. Pat. No. 6,699,648 (Sakizadeh et al.), and U.S. Pat. No. 6,762,013 (Sakizadeh et al.) can be used. All of these patents are incorporated herein by reference.

Preferred embodiments of thermographic materials include a conductive layer on one or both sides of the support, more preferably on the backside of the support and especially where it is buried or underneath one or more other layers such as backside protective layer(s). Such backside conductive layers typically have a resistivity water electrode resistivity (WER) of $1\times10^{12}$ ohms/sq or less and preferably $1\times10^{11}$ ohms/sq or less at 70° F. (21.1° C.) and 50% relative humidity.

In such preferred embodiments, the conductive layer includes one or more specific non-acicular metal antimonate particles such as non-acicular metal antimonate particles composed of $ZnSb_2O_6$ as described in U.S. Pat. No. 6,689,546 (LaBelle et al.), and in commonly assigned U.S. Publications 2006/0046932 and 2006/0046215 (Ludemann et al.) and U.S. Pat. No. 7,067,242 (Ludemann et al.). All of the above patents and patent applications are incorporated herein by reference.

The photothermographic and thermographic materials may also usefully include a magnetic recording material as described in *Research Disclosure*, Item 34390, November 1992, or a transparent magnetic recording layer such as a layer containing magnetic particles on the underside of a transparent support as described in U.S. Pat. No. 4,302,523 (Audran et al.).

To promote image sharpness, photothermographic materials can contain one or more layers containing acutance and/or antihalation dyes. These dyes are chosen to have absorption close to the exposure wavelength and are designed to absorb scattered light. One or more antihalation compositions may be incorporated into one or more antihalation backing layers, underlayers, or overcoats. Additionally, one or more acutance dyes may be incorporated into one or more frontside layers.

Dyes useful as antihalation and acutance dyes include squaraine dyes as described in U.S. Pat. No. 5,380,635 (Gomez et al.) and U.S. Pat. No. 6,063,560 (Suzuki et al.), and EP 1 083 459A1 (Kimura), indolenine dyes as described in EP 0 342 810A1 (Leichter), and cyanine dyes as described in U.S. Pat. No. 6,689,547 (Hunt et al.), all incorporated herein by reference.

It is also useful to employ compositions including acutance or antihalation dyes that will decolorize or bleach with heat during processing, as described in U.S. Pat. No. 5,135,842 (Kitchin et al.), U.S. Pat. No. 5,266,452 (Kitchin et al.), U.S. Pat. No. 5,314,795 (Helland et al.), and U.S. Pat. No. 6,306,566, (Sakurada et al.), and Japanese Kokai 2001-142175 (Hanyu et al.) and 2001-183770 (Hanyu et al.). Useful bleaching compositions are also described in Japanese Kokai 11-302550 (Fujiwara), 2001-109101 (Adachi), 2001-51371 (Yabuki et al.), and 2000-029168 (Noro). All of the noted publications are incorporated herein by reference.

Other useful heat-bleachable antihalation compositions can include an infrared radiation absorbing compound such as an oxonol dye or various other compounds used in combination with a hexaarylbiimidazole (also known as a "HABI"), or mixtures thereof. HABI compounds are described in U.S. Pat. No. 4,196,002 (Levinson et al.), U.S. Pat. No. 5,652,091 (Perry et al.), and U.S. Pat. No. 5,672,562 (Perry et al.), all incorporated herein by reference. Examples of such heat-bleachable compositions are described in U.S. Pat. No. 6,455,210 (Irving et al.), U.S. Pat. No. 6,514,677 (Ramsden et al.), and U.S. Pat. No. 6,558,880 (Goswami et al.), all incorporated herein by reference.

Under practical conditions of use, these compositions are heated to provide bleaching at a temperature of at least 90° C. for at least 0.5 seconds (preferably, at a temperature of from about 100° C. to about 200° C. for from about 5 to about 20 seconds).

In some embodiments, the thermally developable materials include a surface protective layer over one or more imaging layers on one or both sides of the support. In other embodiments, the materials include a surface protective layer on the same side of the support as the one or more emulsion layers and a layer on the backside that includes the required conductive antistatic composition (with or without an antihalation composition or layer). A separate non-conductive, backside surface protective layer can also be included in these embodiments.

The thermally developable formulations can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), and U.S. Pat. No. 5,861,195 (Bhave et al.) and GB 837,095 (Ilford). A typical coating gap for the emulsion layer can be from about 10 to about 750 μm, and the layer can be dried in forced air at a temperature of from about 20° C. to about 100° C. It is preferred that the thickness of the layer be selected to provide maximum image densities greater than about 0.2, and more preferably, from about 0.5 to about 5.0 or more, as measured by an X-rite Model 361/V Densitometer equipped with 301 Visual Optics, available from X-rite Corporation, (Granville, Mich.).

Subsequently to or simultaneously with application of the emulsion formulation to the support, a protective overcoat formulation can be applied over the emulsion formulation.

Preferably, two or more layer formulations are applied simultaneously to a support using slide coating, the first layer being coated on top of the second layer while the second layer is still wet. The first and second fluids used to coat these layers can be the same or different solvents.

In other embodiments, a "carrier" layer formulation comprising a single-phase mixture of the two or more polymers described above may be applied directly onto the support and thereby located underneath the emulsion layer(s) as described in U.S. Pat. No. 6,355,405 (Ludemann et al.), incorporated herein by reference. The carrier layer formulation can be applied simultaneously with application of the emulsion layer formulation.

While the thermographic and photothermographic layers can be coated on one side of the film support, manufacturing methods can also include forming on the opposing or backside of the polymeric support, one or more additional layers, including for example, a conductive layer, an antihalation layer, a layer containing a matting agent (such as silica), or a combination of such layers. Alternatively, one backside layer can perform several or all of the desired functions.

Imaging/Development

The thermally developable materials can be imaged in any suitable manner consistent with the type of material using any suitable imaging source (typically some type of radiation or electronic signal for photothermographic materials and a source of thermal energy for thermographic materials). In some embodiments, the materials are sensitive to radiation in the range of from about at least 300 nm to about 1400 nm, and preferably from about 300 nm to about 850 nm. In other embodiments, the materials are sensitive to radiation at 700 nm or greater (such as from about 750 to about 950 nm).

Imaging can be achieved by exposing the photothermographic materials to a suitable source of radiation to which they are sensitive, including X-radiation, ultraviolet radiation, visible light, near infrared radiation and infrared radiation to provide a latent image. Suitable exposure means are well known and include sources of radiation, including: incandescent or fluorescent lamps, xenon flash lamps, lasers, laser diodes, light emitting diodes, infrared lasers, infrared laser diodes, infrared light-emitting diodes, infrared lamps, or any other ultraviolet, visible, or infrared radiation source readily apparent to one skilled in the art, and others described in the art, such as in *Research Disclosure*, September, 1996, item 38957. Particularly useful infrared exposure means include laser diodes, including laser diodes that are modulated to increase imaging efficiency using what is known as multi-longitudinal exposure techniques as described in U.S. Pat. No. 5,780,207 (Mohapatra et al.). Other exposure techniques are described in U.S. Pat. No. 5,493,327 (McCallum et al.).

Thermal development conditions will vary, depending on the construction used but will typically involve heating the imagewise exposed material at a suitably elevated temperature, for example, from about 50° C. to about 250° C. (preferably from about 80° C. to about 200° C. and more preferably from about 100° C. to about 200° C.) for a sufficient period of time, generally from about 1 to about 120 seconds. Heating can be accomplished using any suitable heating means.

The thermographic materials can be imaged in any suitable manner consistent with the type of material using any suitable source of thermal energy. The image may be "written" simultaneously with development at a suitable temperature using a thermal stylus, a thermal print head, or a laser beam, or by heating while in contact with a heat-absorbing material. The thermographic materials may include a dye (such as an IR-absorbing dye) to facilitate direct development by exposure to laser radiation.

Use as a Photomask

The thermographic and photothermographic materials can be sufficiently transmissive in the range of from about 350 to about 450 nm in non-imaged areas to allow their use in a method where there is a subsequent exposure of an ultraviolet or short wavelength visible radiation sensitive imageable medium. The heat-developed materials absorb ultraviolet or short wavelength visible radiation in the areas where there is a visible image and transmit ultraviolet or short wavelength visible radiation where there is no visible image. The heat-developed materials may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate. Exposing the imageable material to the imaging radiation through the visible image in the exposed and heat-developed thermographic or photothermographic material provides an image in the imageable material. This method is particularly useful where the imageable medium comprises a printing plate and the photothermographic material serves as an imagesetting film.

Thus, in some other embodiments wherein the thermographic or photothermographic material comprises a transparent support, the image-forming method further comprises, after step (A') or steps (A) and (B) noted above:

(C) positioning the imaged, heat-developed photothermographic or thermographic material between a source of imaging radiation and an imageable material that is sensitive to the imaging radiation, and (D) thereafter exposing the imageable material to the imaging radiation through the visible image in the exposed and heat-developed photothermographic material to provide an image in the imageable material.

The following examples are provided to illustrate the practice of the present invention and the invention is not meant to be limited thereby.

MATERIALS AND METHODS FOR THE EXAMPLES

BUTVAR® B-79 is a polyvinyl butyral resin available from Solutia, Inc. (St. Louis, Mo.).

BYK-022 is a defoamer and is available from Byk-Chemie Corp. (Wallingford, Conn.).

CELVOL® V203S is a polyvinyl alcohol and is available from Celanese Corp. (Dallas, Tex.).

TRITON® X-114 is a nonionic surfactant and is available from Dow Chemical Corp. (Midland Mich.).

The Sonifier® Cell Disruptor 350 was manufactured by Branson Sonic Power Co. (Danbury, Conn.)

Water used in the preparations was deionized and low in chloride ions.

ZONYL FS-300 is a nonionic fluorosurfactant that is available from E. I. DuPont de Nemours & Co. (Wilmington, Del.).

Compound A-1 is described in U.S. Pat. No. 6,605,418 (noted above) and is believed to have the following structure:

(A-1)

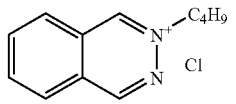

DEV-1 is 1,1'-bis(2-hydroxy-3,5-dimethylphenyl)-3,5,5-trimethyl-hexane(CAS RN [7292-14-0]) and is available from St-Jean PhotoChemicals, Inc. (Quebec). It is also known as NONOX® or PERMANAX WSO.

(DEV-1)

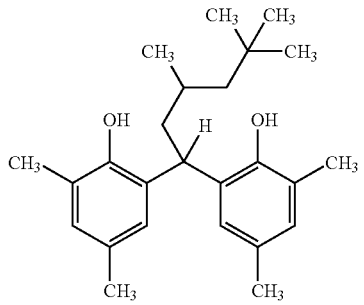

Compound T-1 is the sodium salt of 2,4-dihydro-4-(phenylmethyl)-3H-1,2,4-triazole-3-thione. It is believed to have the structure shown below. It may also exist as the sodium salt of the thione tautomer. The silver salt of this compound is referred to as AgT-1.

(T-1)

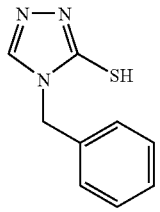

Compound AF-1 is the potassium salt of 2,2'-dibromo-2-(4-methylphenylsulfonyl-N-(2-sulfoethyl)acetamide. Its preparation is described in U.S. Pat. No. 6,630,291 and it is believed to have the following structure.

(AF-1)

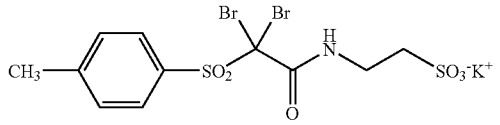

Compound AF-2 is 2-dibromo-2-(4-methylphenylsulfonyl)-acetamide. It can be prepared as described in U.S. Pat. No. 3,955,982 (van Allan), and it is believed to have the following structure.

(AF-2)

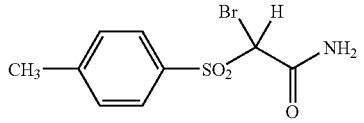

Blue sensitizing dye SSD-1 is believed to have the following structure.

(SSD-1)

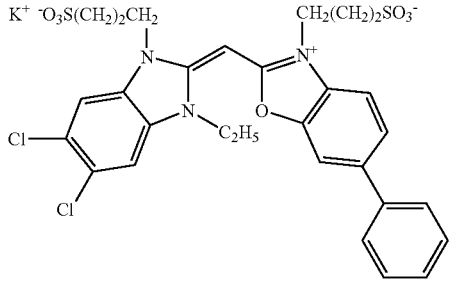

Compound SS-1a is described in U.S. Pat. No. 6,296,998 (Eikenberry et al.) and is believed to have the following structure.

(SS-1a)

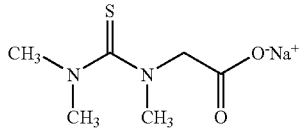

Silver Behenate Preparation:

To a well-stirred solution consisting of 22.7 kg of water, 2.500 kg of methanol, and 111.14 g of NaOH (2.78 mole), at 70° C., was added 1036.9 g of behenic acid (3.044 mole), (nominally 90% behenic acid recrystallized from isopropanol to purify). The mixture was heated to 90° C. and held at this temperature for 30 minutes. The mixture was then cooled to 70° C. and 857.9 g of a 5.72M solution of $AgNO_3$ (2.77 moles) was added over 30 minutes and then held at this temperature for an additional 30 minutes. The resulting mixture was cooled to 25° C. and the resulting product was filtered and washed repeatedly until the wash water had a conductivity of less than 1000 μS/cm. The resulting solid product was dried in a vacuum oven for 3 days at 50° C.

Preparation of Freeze-dried Silver Benzotriazole:

A dispersion of silver benzotriazole was prepared by concurrently adding a solution of silver nitrate, and a solution of sodium benzotriazole into a stirred aqueous bone gelatin solution. The small particle dispersion was centrifuged and the solid phase was resuspended in water, treated with a protolytic enzyme at 35° C. to destroy the gelatin, centrifuged, washed with water, resuspended in water, sonicated, and finally freeze-dried to a free-flowing white powder.

Reducing Agent Dispersion:

A solid particle dispersion of a reducing agent was prepared by combining 20 weight % L-ascorbic acid 6-O-palmitate, 1 weight % D-iso-ascorbic acid, 2 weight % CELVOL™ V203S poly(vinyl alcohol), 0.6 weight % TRITON® X-114 surfactant, 0.02 weight % of BYK-022, and 77.38 weight % of high purity water. The mixture was circulated in a media mill with 0.7 mm zirconium silicate ceramic beads until the dispersion achieved a median particle size of approximately 0.45 μm as measured by light scattering. This required about 7 hours. Examination of the final dispersion by transmitted light microscopy at 1000× magnification showed well-dispersed particles, all below 1 μm.

Preparation of Sodium 6-Bromohexanoate:

To a well-mixed solution of 20 g of water and 14.6 g of 6-bromohexanoic acid (0.075 mole) at 20° C. was added a 5.0M NaOH solution to adjust the pH to 7.5 (~0.075 mole). The water was removed under vacuum and the resulting solid was ground to a free-flowing white powder.

Preparation of Tetraethylammonium Behenate:

A mixture of 100 g water, 8.95 g of behenic acid (20 mmole), and 8.0 g of a 35 weight % solution of tetraethylammonium hydroxide was heated to 70° C. with stirring. Then an additional 0.16 g of the tetraethylammonium hydroxide solution was added to adjust the pH to 8.3 (~20 mmole total). The resulting opalescent solution was freeze dried to yield a white free-flowing powder.

Preparation of Tetraethylammonium 2,3-Dihydroxybenzoate:

To 20 g of water and 3.08 g of 2,3-dihydroxybenzoic acid (20 mmole) at 20° C. was added a 35 weight % solution of tetraethylammonium hydroxide to adjust the pH to 7.9 (8.1 g required, ~20 mmole). The resulting solution was freeze dried to yield a tan colored free-flowing powder.

Comparative Example 1

In a 30 ml beaker were added 987 mg (2.0 mmole) of silver behenate, 0.20 g of BUTVAR® B-79 polyvinyl butyral resin (Solutia, Inc.), and 17 g of methyl ethyl ketone (MEK). The beaker was placed in an ice-water bath and sonicated for 3 minutes using a Sonifier® Cell Disruptor 350 equipped with a 0.75 inch (1.9 cm) probe tip and set on 50% duty cycle and 5.5 power output (the ice-water bath maintained the mixture at temperatures near 20° C. during sonication). Then, 0.16 g of phthalazinone and 0.285 g of 2,3-dihydroxybenzoic acid were added and the mixture was sonicated as before but for 1 minute at a 3.0 power output. Then 2.0 g of BUTVAR® B-79 polyvinyl butyral resin was added to the mixture at room temperature and it was stirred for about 5 minutes. The mixture was filtered through a fine mesh screen and hand coated using a knife-coater having a 0.23 mm gap onto a clear poly(ethylene terephthalate) support having a thickness of 0.178 mm and dried at 43° C. to prepare a direct thermographic material.

Silver analysis of the dried coating indicated the final component coverage was 1.26 g silver/$m^2$ (5.73 g of silver behenate/$m^2$), 0.93 g/$m^2$ of phthalazinone, 1.66 g/$m^2$ of 2,3-dihydroxybenzoic acid, and 12.8 g/$m^2$ BUTVAR® B-79 polyvinyl butyral resin.

Invention Examples 1–5

These examples were prepared similarly to that of Comparative Example 1 except that an amount of tetraethylammonium acetate tetrahydrate was added just prior to sonication. The mol % of tetraethylammonium acetate ("TEA" acetate) relative to the silver is shown in TABLE I below.

Comparative Example 2

This example was prepared similarly to that of Comparative Example 1 except that no phthalazinone was added.

Invention Examples 6–12

These examples were prepared similarly to that of Comparative Example 2 (no phthalazinone) except that an amount of tetraethylammonium acetate tetrahydrate was added just prior to the first sonication. The mole percent of tetraethylammonium acetate ("TEA" acetate) relative to the silver is shown in TABLE II below.

Comparative Example 3

This comparative example was prepared similarly to Comparative Example 1 except that 43 mg (0.2 mmole) of sodium 6-bromohexanoate (10 mol % relative to silver) were added just prior to the first sonication. (see TABLE III below).

Invention Example 13

This example was prepared similarly to that of Comparative Example 3 except that, in addition to the sodium 6-bromohexanoate, 52 mg of tetraethylammonium acetate tetrahydrate (10 mol % relative to silver) were added just prior to the first sonication. (see TABLE III below).

Invention Examples 14–16

These examples were prepared similarly to that of Comparative Example 1 except that 10 mol % (relative to silver) of the quaternary ammonium salts listed in TABLE III was added just prior to the first sonication.

Invention Examples 17–28

These examples were prepared similarly to that of Comparative Example 2 (no phthalazinone) except that 10 mol % (relative to silver) of the quaternary ammonium salts listed in TABLE IV was added just prior to the first sonication.

Invention Example 29

This example was prepared similarly to that of Comparative Example 2 except that 0.075 ml of an aqueous solution containing 0.1 mmol of di-tetramethylammonium oxalate (prepared by dissolving oxalic acid into a 25 wt. % solution of tetramethylammonium hydroxide) were added just prior to the first sonication.

Invention Example 30

This example was prepared similarly to that of Comparative Example 2 except that the amount of 2,3-dihydroxybenzoic acid was reduced by 0.2 mmol and 0.2 mmol of tetraethylammonium 2,3-dihydroxybenzoate were added with the 2,3-dihydroxybenzoic acid.

Comparative Example 4

This comparative example were prepared similarly to that of Comparative Example 2 except that 75 mg of sodium sulfate, recrystallized from water and ground to a fine powder, were added just prior to the first sonication. Analysis (TGA) of the sodium sulfate showed it to contain 52 wt. % water.

Comparative Examples 5–8

These comparative examples were prepared similarly to that of Comparative Example 2 except that in place of the 1.85 mmole of 2,3-dihydroxy-benzoic acid (1.85 mmole) were added 1.85 mmole of the reducing agents shown in TABLE IV below.

Invention Examples 31–34

These examples were prepared similarly to that of Comparative Examples 5–8 except that 52 mg of tetraethylammonium acetate (0.2 mmol) were added prior to the first sonication.

Coating, Processing, and Data:

The individual coatings were cut into small strips for a determination of the development-density produced at various process temperatures (20° C. and 100 to 170° C. in 5° C. increment) for development times of 5, 10, 15, and 20 seconds. The strips were immersed in silicone oil at the desired temperature for the desired time. They were then rinsed in hexane and the resulting density was read using a combination of Status A filters as a visual density using a Macbeth TD504 densitometer and the appropriate filters (see T. H. James, *The Theory of the Photographic Process*, Fourth Edition, Macmillan Publishing Co., Inc., N.Y., 1977, p 521 for details of this process). A density vs. temperature plot was constructed for each of the four development times. The temperatures required to reach a density of 2.0 were measured for the coatings. The temperature difference between the appropriate control and invention coatings were tabulated and given in TABLES I–VI below. A negative value means that the Invention curve reached a 2.0 density at a lower temperature than the Control curve.

The coatings containing halide ion were also examined for printout (TABLE VI). The fresh non-processed coating density was compared to that obtained after being exposed for 24 hours to fluorescent lighting (about 65 foot-candles or 699 lux) while in an environment of 77% relative humidity and 21° C.

The data in TABLES I and II demonstrate the significant lowering in development temperature even when tetramethylammonium acetate ("TEA" acetate) was present at 1.25 mol % relative to the total silver (from the silver behenate). The effect progressively increases with higher levels of the quaternary ammonium salt. In the absence of the toner phthalazinone, the control material had a lower development temperature of about −6° C. (compare Comparative Examples 1 and 2) but the effect of tetramethylammonium acetate levels on development temperature were similar when compared to their appropriate control coating.

TABLE I

Development Temperature Reduction with Tetraethylammonium Acetate Containing 0.93 g/m$^2$ Phthalazinone

| Thermographic Material | Mol % "TEA" Acetate Relative to Ag | Displacement of Density Curve for 5, 10, 15, 20 seconds (° C.)[a] |
|---|---|---|
| Comparative Example 1 | 0% | (Control)[b] |
| Invention Example 1 | 1.25% | −7, −8, −8, −8 |
| Invention Example 2 | 2.5% | −11, −12, −13, −13 |
| Invention Example 3 | 5% | −13, −18, −18, −18 |
| Invention Example 4 | 10% | −21, −24, −24, −23 |
| Invention Example 5 | 20% | −35, −36, −36, −36 |

[a]For all coatings the Dmin was 0.06 or less and the Dmax was at least 3.0.

[b]Temp to reach density of 2.0 at 5, 10, 15, 20 sec. is 154, 149, 148, 146° C.

TABLE II

Development Temperature Reduction with TEA Acetate, No Phthalazinone

| Thermographic Material | Mol % "TEA" Acetate Relative to Ag | Displacement of Density Curve for 5, 10, 15, 20 seconds (° C.)[a] |
|---|---|---|
| Comparative Example 2 | 0% | (Control)[b] |
| Invention Example 6 | 1.25% | −8, −12,−13, −11 |
| Invention Example 7 | 2.5% | −12, −14, −14, −13 |
| Invention Example 8 | 5% | −18, −18, −18, −17 |
| Invention Example 9 | 10% | −26, −27, −28, −26 |
| Invention Example 10 | 20% | −37, −38, −38, −37 |
| Invention Example 11 | 40% | −34, −36, −38, −36 |
| Invention Example 12 | 100% | −33, −33, −33, −34 |

[a]For all coatings the Dmin was 0.06 or less and the Dmax was at least 3.0.

[b]Temp to reach density of 2.0 at 5, 10, 15, 20 sec. is 148, 144, 142, 139° C.

TABLE III

Development Temperature Reduction with Quaternary Ammonium Salts at 10 mol % of Silver and Containing 0.93 g/m$^2$ of Phthalazinone

| Thermographic Material | Quaternary Ammonium Salt or Other Additive | Displacement of Density Curve for 5, 10, 15, 20 seconds (° C.)[a] |
|---|---|---|
| Comparative Example 1 | None, (Control) | Control |
| Comparative Example 3 | Na 6-bromohexanoate | −12, −13, −12, −12 |
| Invention Example 4 | Tetraethylammonium acetate | −21, −24, −24, −23 |
| Invention Example 13 | Na 6-bromohexanoate + "TEA" acetate | −27, −27, −27, −27 |
| Invention Example 14 | Tetraethylammonium cyanide | −17, −19, −18, −19 |
| Invention Example 15 | Tetramethylammonium hydroxide | −21, −19, −18, −19 |
| Invention Example 16 | Tetramethylammonium nitrate | −10, −12, −11, −12 |

[a]For all coatings the Dmin was 0.05 or less and the Dmax was at least 3.0.

TABLE IV

Development Temperature Reduction with Quaternary Ammonium Salts at 10 mol % of Silver and Containing No Phthalazinone

| Thermographic Material | Quaternary Ammonium Salt or other additive | Displacement of Density Curve, 5, 10, 15, 20 Seconds Development (° C.)[a] |
|---|---|---|
| Comparative Example 2 | None | (Control) |
| Comparative Example 4 | Sodium sulfate octahydrate | −3, 0, 0, 0 |
| Invention Example 17 | Tetrabutylammonium acetate | −18, −20, −21, −22 |
| Invention Example 18 | Tetrahexylammonium hydrogen sulfate | −11, −12, −13, −13 |
| Invention Example 19 | Tetraoctylammonium fluoride | −15, −13, −15, −16 |
| Invention Example 20 | Tetraethylammonium nitrate | −21, −22, −22, −22 |
| Invention Example 21 | Tetramethylammonium formate | −47, −47, −45, −44 |
| Invention Example 22 | Tetraethylammonium fluoride | −21, −22, −21, −21 |
| Invention Example 23 | Tetramethylammonium acetate | −31, −31, −28, −31 |
| Invention Example 24 | Cetyltrimethylammonium hydrogen sulfate | −15, −14, −17, −17 |
| Invention Example 25 | Tetraethylammonium behenate | −22, −20, −20, −20 |
| Invention Example 26 | 1-Ethyl-4-(methoxycarbonyl)-pyridinium iodide | −25, −25, −23, −24 |
| Invention Example 27 | 1-Ethyl-3-methyl-1H-imidazolium trifluoromethanesulfonate | −24, −24, −24, −27 |
| Invention Example 28 | Tetramethylammonium 6-bromohexanoate | −27, −26, −26, −26 |
| Invention Example 29 | Di-tetramethylammonium oxalate (TMA at 10 mol % of Silver) | −33, −31, −28, −28 |
| Invention Example 30 | Tetraethylammonium 2,3-dihydroxybenzoate | −22, −21, −21, −21 |

[a]For all coatings the Dmin was 0.05 or less and the Dmax was at least 2.8.

The data presented in TABLES III and IV above show that the effect of lower development temperature was significant when a quaternary ammonium salt was present. It appears that the anion portion of the quaternary ammonium salt is not an important part of causing this effect but it can affect the magnitude of the effect, perhaps due to the salt solubility during coating formulation, formation of water-insoluble silver salts (as with halide anions), pH changes of the final coating, or introducing as a mild reducing agent (see for example, the use of formate anion in Invention Example 21 and oxalate anion in Invention Example 29). The development temperature lowering effect appears to be additive with that previously observed for selective halide releasing halo-organic compounds (compare Comparative Example 3 and Invention Example 4 with Invention Example 13 in TABLE III).

Comparative Example 4 showed little effect from adding sodium sulfate octahydrate to the thermographic emulsion. This result suggests that water possibly introduced as a hydrated salt, does not cause a large reduction in process temperature.

The data presented in TABLE V below demonstrate that the reduction in process temperature caused by the presence of tetraethylammonium acetate occurred when a variety of reducing agents were used.

TABLE V

Temperature Reduction from Tetraethylammonium Acetate at 10 mol % on Different Reducing Agents, No Phthalazinone

| Thermographic Material | Reducing Agent | "TEA" Acetate | (Control Temp) and Temp Change for 5, 10, 15, 20 sec (° C.) |
|---|---|---|---|
| Comparative Example 2 | 2,3-Dihydroxybenzoic acid | No | 148, 144, 142, 139° C.[a] |
| Invention Example 9 | 2,3-Dihydroxybenzoic acid | YES | −26, −27, −28, −26[a] |
| Comparative Example 5 | 4-Amino-2,6-dichlorophenol | No | 107, 104, 102, 101° C.[b] |
| Invention Example 31 | 4-Amino-2,6-dichlorophenol | YES | −16, −13, −11, −10[b] |
| Comparative Example 6 | Chlorohydroquinone | No | 145, 137, 132, 129° C.[b] |
| Invention Example 32 | Chlorohydroquinone | YES | −23, −35, −32, −31[b] |
| Comparative Example 7 | 3,4-Dihydroxybenzaldehyde | No | 146, 138, 135, 134° C.[a] |
| Invention Example 33 | 3,4-Dihydroxybenzaldehyde | YES | −21, −21, −21, −21[a] |
| Comparative Example 8 | Ascorbic acid 6-palmitate | No | 86, 83, 81, 81° C.[b] |
| Invention Example 34 | Ascorbic acid 6-palmitate | YES | −5, −7, −7, −8[b] |

[a]Dmax was at least 3.0 and temperature measured at visual density of 2.0.
[b]Dmax was ~2.0 and therefore temperature measured at visual density of 1.0.

Comparative Example 9

This example was prepared similarly to that of Comparative Example 1 except that the silver behenate used was prepared in the following manner.

To 400 g of water containing 38.4 g of 1M sodium hydroxide (37 mmole) were added 12.98 g of behenic acid (38.1 mmole). The mixture was heated to 90° C. to dissolve the acid. At 80° C. and with good stirring were added, at 3 ml/min, 42.1 g of 1M $AgNO_3$ (37 mmole). The resulting mixture was held at 80° C. for 10 minutes and then cooled to 40° C. It was divided into two equal parts. One part was centrifuged and washed 6 times using 500 ml of water for each wash and then the resulting past was freeze-dried to a white free-flowing powder. The other unwashed part was used to prepare Comparative Example 10 (see TABLE VI below for the results).

Comparative Example 10

This example was prepared similarly to that of Comparative Example 1 except that the silver behenate used was treated with 10 mol % of sodium bromide. It was prepared in the following manner.

To the other unwashed Ag behenate portion described in Comparative Example 9 were added, with good mixing, 18.6 g of a 0.10M sodium bromide solution (1.85 mmol) at 1.0 ml/min and then the mixture was held for 10 minutes. It was washed and freeze-dried to yield a white free-flowing powder. A portion of the freeze-dried powder was analyzed for halide by neutron activation analysis and found it to contain 14 mol % bromide per mol silver (see TABLE VI below for the results).

Comparative Example 11

This example was prepared similarly to that of Comparative Example 1 except that the silver behenate used was prepared in the following manner.

To 400 g of water containing 38.4 g of 1M sodium hydroxide (37 mmole) were added 12.98 g of behenic acid (38.1 mmole). The mixture was heated to 90° C. to dissolve the acid. At 80° C. and with good stirring were added 46.3 g of a 1M $AgNO_3$ solution (37 mmole) at 3 ml/min and 38.0 g of a 0.1M sodium bromide solution (3.7 mmole, 10 mol % relative to silver) at 3 ml/min. The resulting mixture was held at 80° C. for 10 minutes and then cooled to 40° C. The suspension was centrifuged and washed 6 times using 1 liter of water for each wash, and then the resulting past was freeze-dried to a white free-flowing powder. A portion of the freeze-dried powder was analyzed for halide by neutron activation analysis and found to contain 9 mol % bromide per mol silver (see TABLE VI below for the results).

Invention Example 35

This example was prepared similarly to that of Comparative Example 10 except that only 16 g of MEK were used and 1 g of a methanolic solution containing 42 mg of tetraethylammonium bromide (10 mol % relative to silver) was added just prior to the second sonication. (See TABLE VI below for the results.)

From TABLE VI, it can be seen that the coating of Invention Example 35 containing the tetraethylammonium cation showed a much larger lowering of development temperature than those coatings containing only halide. All of the thermographic materials containing halide showed printout (that is, density increased in the unprocessed coating after 24-hour fluorescent light exposure at 77% R.H., 21° C.).

TABLE VI

Temperature Reduction from Halide Salts

| Thermographic Material | Silver Halide Present during Silver Behenate Preparation | Quaternary Ammonium Salt | Displacement of Density Curve for 5, 10, 15, 20 seconds (° C.) | Print-out Density Increase (fresh $D_{min}$) |
|---|---|---|---|---|
| Comparative Example 9 | None | None | 0, 0, 0, 0 | 0.00(0.04) |
| Comparative Example 10 | Sodium Bromide | None | −7, −9, −8, −7 | 0.05(0.10) |
| Comparative Example 11 | Silver Bromide | None | −4, −5, −4, −4 | 0.07(0.10) |
| Invention Example 35 | None | Tetraethylammonium Bromide | −29, −32, −33, −34 | 0.05(0.07) |

Comparative Example 12

Using Silver Benzotriazole as Silver Source

This comparative example was prepared similarly to that of Comparative Example 2 except that 486 mg of freeze-dried silver benzotriazole was used in place of the silver behenate.

Invention Example 36

Using Silver Benzotriazole as Silver Source

This inventive example was prepared similarly to that of Inventive Example 4 except that 486 mg of freeze-dried silver benzotriazole was used in place of the silver behenate. Thus, compared to Comparative Example 12, it additionally contained 10 mol % (relative to total silver) of tetraethylammonium acetate tetrahydrate.

Evaluation of Samples:

The individual coatings of Comparative Example 12 and Inventive Example 36 were cut into small film strips for a determination of the development-density produced at various process temperatures (20° C. and 140 to 205° C. in 5° C. increment) for development times of 5, 10, 15, and 20 seconds. The film strips were immersed in silicone oil at the desired temperature for the desired time. They were then rinsed in hexane and the resulting density was read as described above. Density vs. temperature plots were constructed for each of the four development times. For a given development time, the temperature shift needed to best overlay the comparative and inventive example curves was measured and are as follows: 5 sec. −31° C., 10 sec. −31° C., 15 sec. −33° C., 20 sec. −34° C. A negative temperature values mean that Inventive Example 36 developed at a lower temperature than did Comparative Example 12. This shows that, using silver benzotriazole as the silver source in a thermographic material, the inclusion of tetraethylammonium acetate lowered the development temperature.

Invention Example 37

Photothermographic Material

To a 30 ml beaker were added 987 mg (2.0 mmole) of silver behenate, 0.20 g of BUTVAR® B-79 polyvinyl butyral resin, 52 mg of tetraethylammonium acetate tetrahydrate, and 17 g of methyl ethyl ketone (MEK). The beaker was placed in an ice-water bath and sonicated for 3 minutes using a Sonifier® Cell Disruptor 350 equipped with a 0.75 inch (1.9 cm) probe tip and set on 50% duty cycle and 5.5 power output (the ice-water bath maintained the mixture at temperatures near 20° C. during sonication). Red safe lights were used throughout the remainder of this example. A solution of 45 mg of zinc bromide dissolved in 1 ml of methanol was added to the stirred mixture over about 1 minute. The zinc bromide in the presence of silver behenate results in the formation of silver bromide that serves as the photocatalyst. After stirring for 10 minutes, 0.285 g of 2,3-dihydroxybenzoic acid were added and the mixture was stirred for 20 minutes. Then 2.0 g of BUTVAR® B-79 polyvinyl butyral resin were added to the mixture at room temperature and the mixture was stirred for about 10 minutes. The mixture was filtered through a fine mesh screen and hand coated using a knife-coater having a 0.23 mm gap onto clear poly(ethylene terephthalate) support having a thickness of 0.178 mm and dried using a coating block warmed to 43° C., to prepare a photothermographic material of this invention.

Comparative Example 13

This example was prepared similarly to that of Invention Example 37 except that the tetraethylammonium acetate tetrahydrate was omitted.

Evaluation of Samples:

The coatings of Invention Example 37 and Comparative Example 13 were dried, cut into film strips, exposed using an EG&G Sensitometer Mark VII equipped with a xenon lamp for 0.001 second. An opaque object was placed on a portion of the film sample to prevent exposure. The film samples were then thermally developed for 15 seconds by immersion in a silicone oil bath at various temperatures in 5° C. increments. The minimum temperature that showed at least a 0.05 density difference between the exposed and non-exposed regions was noted. This gave the temperature for the onset of thermal development. The material of Invention Example 37 had an onset temperature of 100° C. and the material of Comparative Example 13 had an onset temperature of 115° C. This demonstrates that the tetraethyl ammonium acetate was effective in reducing the development temperature of the photothermographic material.

Aqueous-Based Photothermographic Examples:

Preparation of Coating Formulation:

A coating formulation was prepared by dissolving 4.4 g of gelatin (cattle bone, alkali treated, deionized gelatin) in 52 g of water. At 40° C., were added 42 g of an aqueous nanoparticulate silver behenate dispersion (2.10 Kg/mol Ag) prepared as described in U.S. Pat. No. 6,630,291 (noted above). To this mixture, were added 0.4 ml of AF-2 (also described in U.S. Pat. No. 6,630,291) in a solid particle dispersion, 0.92 ml of a 25 g/l aqueous solution of AF-1 (also described in U.S. Pat. No. 6,630,291). Then, 1.1 g of solid succinimide and 1.2 ml of a solution containing 60 mg of sodium iodide were added with stirring. After 20 minutes, were added 12 g of a 20 wt. % solid particle dispersion of reducing agent DEV-1 (also described in U.S. Pat. No. 6,630,291). After 20 minutes of stirring, 1.2 g of a 100 g/l aqueous solution of 4-methyl phthalic acid were added. Then 2.0 g of a primitive silver iodobromide cubic grain emulsion, with grains having 48 nm in edge length and containing 1.52 mmol of Ag and 30 mg of gelatin were then added. A coating surfactant (0.75 ml) was also added.

Comparative Example 14

To a 29.5 g portion of the above coating formulation was added 1.5 ml of water. The resulting photothermographic emulsion was then coated at a wet coverage of 100 g/m$^2$ onto a gelatin-subbed poly(ethylene terephthalate) support. The resulting coatings were dried and cut into sample film strips.

Invention Example 38

This example was prepared similarly to that of Comparative Example 14 except the 1.5 ml of water were replaced with 1.5 ml of a solution containing 261 mg of tetraethylammonium acetate tetrahydrate (20 mol % relative to the silver behenate).

Evaluation of Samples:

The film samples were evaluated similarly to those of Comparative Example 13 and Invention Example 37 described above. The coating of Invention Example 38 had a development onset of 105° C. and Comparative Example 14 had a development onset of 115° C. This demonstrates that the tetraethylammonium acetate was effective in reducing the development temperature of an aqueous-based photothermographic material.

Comparative Example 15

Another aqueous-based photothermographic formulation was prepared as follows:

Preparation of Silver Benzotriazole/AgT-1 Co-Precipitated Dispersion

A stirred reaction vessel was charged with 900 g of lime-processed gelatin, and 6 kg of deionized water. A solution containing 216 g/kg of benzotriazole (BZT), 710 g/kg of deionized water, and 74 g/kg of sodium hydroxide was prepared (Solution A). The mixture in the reaction vessel was adjusted to a pH of 8/9 with 2.5N sodium hydroxide solution, and 0.8 g of Solution A was added to adjust the solution vAg (measured vAg—80 mV). The temperature of the reaction vessel was maintained at 50 C. The second solution containing 363 g/kg of silver nitrate and 638 g/kg of deionized water was prepared (Solution B). A third solution (Solution C) containing 3H-1,2,4-triazole-3-thione, 2,4-dihydro-4-(phenylmethyl)-(T-1, 336 g/kg), sodium hydroxide (70 g/kg), and deionized water (594 g/kg) was also prepared.

Solutions of A and B were then added to the reaction vessel by conventional controlled double-jet addition at the Solution B flow rates given in TABLE VII below, while maintaining constant vAg and pH in the reaction vessel. After consumption of 97.4% total silver nitrate solution (Solution B), Solution A was replaced with Solution C and the precipitation was continued, during which Solutions B and C were added to the reaction vessel by conventional controlled double-jet addition, while maintaining constant vAg and pH in the reaction vessel.

The resulting AgBZT/AgT-1 co-precipitated emulsion was washed by conventional ultrafiltration process as described in *Research Disclosure*, Vol. 131, March 1975, Item 13122. The pH of the AgBZT/AgT-1 emulsion was adjusted to 6.0 using 2.0N sulfuric acid.

TABLE VII

| | Time (min) | Solution B Flow Rate (ml/mm) |
|---|---|---|
| Addition 1 | 20 | 25 |
| Addition 2 | 41 | 25–40 |
| Addition 3 | 30 | 40–80 |

Preparation of Tabular Grain Silver Halide Emulsions:

A reaction vessel equipped with a stirrer was charged with 6 liters of water containing 4.21 g of lime-processed bone gelatin, 4.63 g of sodium bromide, 37.65 mg of potassium iodide, an antifoaming agent, and 1.25 ml of 0.1 molar sulfuric acid. The solution was held at 39° C. for 5 minutes. Simultaneous additions were then made of 5.96 ml of 2.5378 molar silver nitrate and 5.96 ml of 2.5 molar sodium bromide over 4 seconds. Following nucleation, 0.745 ml of a 4.69% solution of sodium hypochlorite was added. The temperature was increased to 54° C. over 9 minutes. After a 5-minute hold, 100 g of oxidized methionine lime-processed bone gelatin in 1.412 liters of water containing additional antifoaming agent 54° C. were then added to the reactor. The reactor temperature was held for 7 minutes, after which 106 ml of a 5 molar sodium chloride solution containing 2.103 g of sodium thiocyanate were added. The reaction was continued for 1 minute.

During the next 38 minutes, the first growth stage took place wherein solutions of 0.6 molar $AgNO_3$, 0.6 molar sodium bromide, and a 0.29 molar suspension of silver iodide (Lippmann) were added to maintain a nominal uniform iodide level of 4.2 mole %. The flow rates during this growth segment were increased from 9 to 42 ml/min (silver nitrate) and from 0.8 to 3.7 ml/min (silver iodide). The flow rates of the sodium bromide were allowed to fluctuate as needed to maintain a constant pBr. At the end of this growth segment, 78.8 ml of 3.0 molar sodium bromide were added and held for 3.6 minutes.

During the next 75 minutes, the second growth stage took place wherein solutions of 3.5 molar silver nitrate and 4.0 molar sodium bromide and a 0.29 molar suspension of silver iodide (Lippmann) were added to maintain a nominal iodide level of 4.2 mole %. The flow rates during this segment were increased from 8.6 to 30 ml/min (silver nitrate) and from 4.5 to 15.6 ml/min (silver iodide). The flow rates of the sodium bromide were allowed to fluctuate as needed to maintain a constant pBr.

During the next 15.8 minutes, the third growth stage took place wherein solutions of 3.5 molar silver nitrate, 4.0 molar sodium bromide, and a 0.29 molar suspension of silver iodide (Lippmann) were added to maintain a nominal iodide level of 4.2 mole %. The flow rates during this segment were 35 ml/min (silver nitrate) and 15.6 ml/min (silver iodide). The temperature was decreased to 47.8° C. during this segment.

During the next 32.9 minutes, the fourth growth stage took place wherein solutions of 3.5 molar silver nitrate and 4.0 molar sodium bromide and a 0.29 molar suspension of silver iodide (Lippmann) were added to maintain a nominal iodide level of 4.2 mole %. The flow rates during this segment were held constant at 35 ml/min (silver nitrate) and 15.6 ml/min (silver iodide). The temperature was decreased to 35° C. during this segment.

A total of 12 moles of silver iodobromide (4.2% bulk iodide) were formed. The resulting emulsion was coagulated using 430.7 g of phthalated lime-processed bone gelatin and washed with de-ionized water. Lime-processed bone gelatin (269.3 g) was added along with a biocide and pH and pBr were adjusted to 6 and 2.5 respectively.

Tabular grains accounted for greater than 99% of the total projected area. The mean ECD of the grains was 2.369 μm. The mean tabular thickness was 0.062 μm. This emulsion was spectrally sensitized with 1.0 mmol of blue sensitizing dye SSD-1 per mole of silver halide. Chemical sensitization was carried out using 0.0055 mmol of sulfur sensitizer (compound SS-1a) per mole of silver halide at 60° C. for 10 minutes.

Preparation of Photothermographic Material:

The following Solutions were prepared as follows. Specific Solution components and their final coated levels are described in Table VIII.

Solution A': Silver benzotriazole/AgT-1 dispersion, water, and gelatin (35% gelatin/65% water) were placed in a stainless steel can and heated to 50° C. for 15 minutes to melt the material. A 5% aqueous solution of 3-methylbenzothiazolium iodide was added with stirring and held for 10 minutes. The sodium salt of benzotriazole was added and the mixture was stirred for 5 minutes, and the mixture was then cooled to 40° C. Mixing for 30 minutes was followed by addition of 2.5 N sulfuric acid to adjust the pH to 5.0. ZONYL® FS300 surfactant was then added, followed by a 12% aqueous solution of Compound A-1.

Solution B': A portion of the tabular-grain silver halide emulsion prepared above, water, and gelatin were placed in a stainless steel can and melted at 40° C.

Solution C': Solution C' was prepared by first adding the dry materials to water and heating to 62° C. until dissolved, followed by cooling to 25° C., followed by addition and mixing of Reducing Agent Dispersion, followed by addition and mixing of a solid-particle dispersion of S(N-phenylcarbamoyl)octadecylthiol.

Solution D': Solution D' was prepared by melting deionized ossein bone gelatin and water in a stainless steel container, then a gelatin dispersion of 6.5 μm diameter polystyrene beads, ZONYL® FS300 surfactant, and aqueous solutions of dimethylurea and boric acid were added.

Solutions A', B', and C' were mixed to provide layer 1. Solution D' was simultaneously applied over layer 1 during coating to form a photothermographic emulsion. Each formulation was coated on a 178 μm thick transparent, blue-tinted poly(ethylene terephthalate) film support to form an imaging layer having the dry composition shown in the following TABLE VIII.

TABLE VIII

| Solution | Component | Dry Coating Weight (mg/m$^2$) |
|---|---|---|
| A' | Silver (from Silver benzotriazole/AgT-1 dispersion) | 1,081 |
| A' | Lime processed gelatin | 776 |
| A' | 3-Methylbenzothiazolium Iodide | 54 |
| A' | Sodium benzotriazole | 54 |
| A' | Mercaptotriazole compound T-1 | 51 |
| A' | ZONYL ® FS300 surfactant | 15 |
| A' | Compound A-1 | 55 |
| B' | Silver (from AgBrI emulsion) | 181 |
| B' | Lime processed gelatin | 848 |
| C' | Succinimide | 130 |

TABLE VIII-continued

| Solution | Component | Dry Coating Weight (mg/m$^2$) |
|---|---|---|
| C' | Dimethylurea | 217 |
| C' | Xylitol | 349 |
| C' | Compound VS-1 | 65 |
| C' | L-ascorbic acid 6-O-palmitate | 2,802 |
| C' | S(N-phenylcarbamoyl)-octadecylthiol | 18 |
| D' | Lime processed gelatin | 1,615 |
| D' | ZONYL ® FS300 surfactant | 33 |
| D' | Polystyrene beads | 108 |
| D' | Dimethylurea | 215 |
| D' | Boric acid | 54 |

Invention Example 39

In the same coating set another coating was made similar to Comparative Example 15 but with tetraethylammonium acetate added to Solution D (the topcoat formulation) at a level of 10 mol % relative to the total silver. The total silver in the material was 1.26 g/m$^2$.

Evaluation of Samples:

Comparative Example 15 and Invention Example 39 were exposed for 1/50th second through a 0–3 graduated density 21 step tablet. The light source was a General Electric Quartzline 750 watt tungsten lamp tuned to 2850 K color temperature and filtered with blue glass and 1.0 neutral density filters to simulate a blue light-emitting fluorescent intensifying screen. The film samples were then thermally developed by heating them for 18 seconds at the temperatures shown in TABLE IX below. As can be seen in TABLE IX, at a development temperature of 150° C., Invention Example 39 gave a higher photographic speed and higher maximum density than did Comparative Example 15. Invention Example 39 at 145° C. gave a higher photographic speed and higher maximum density than did Comparative Example 15 at 150° C. This shows that tetraethylammonium acetate lowered the development temperature of the photothermographic material.

TABLE IX

| Photothermographic Material | Development Temperature (° C.) | $D_{min}$ | $D_{max}$ | Relative Speed* |
|---|---|---|---|---|
| Comparative Example 15 | 135 | 0.27 | 0.39 | [a] |
| " | 140 | 0.28 | 0.53 | [a] |
| " | 145 | 0.27 | 1.00 | [a] |
| " | 150 | 0.29 | 1.84 | 1.48 |
| Invention Example 39 | 135 | 0.27 | 1.03 | [a] |
| " | 140 | 0.28 | 1.52 | 1.00 |
| " | 145 | 0.31 | 2.02 | 1.69 |
| " | 150 | 0.47 | 2.32 | 2.01 |

*Relative speed at 1.0 density above Dmin in LogE
[a]Density too low to measure speed The invention has been described in detail with particular reference to certain preferred embodiments thereof, but it will be understood that variations and modifications can be effected within the spirit and scope of the invention.

The invention claimed is:

1. A black-and-white thermally developable imaging material comprising a support having thereon at least one thermally developable imaging layer comprising a binder, and further comprising, in reactive association:

a) a non-photosensitive source of reducible silver ions, b) a reducing agent for said reducible silver ions, and c) a quaternary ammonium salt that is present in an amount of at least 0.5 mol % based on total silver in said material, provided that said quaternary ammonium salt is not a phthalazine or phthalazine derivative.

2. The material of claim 1 wherein said quaternary ammonium salt is present in an amount of from about 1 to about 100 mol % based on total silver in said material.

3. The material of claim 1 wherein said quaternary ammonium salt is represented by the following Structure (I):

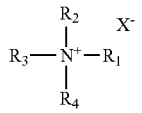

(I)

wherein $R_1$, $R_2$, $R_3$, and $R_4$ are independently aliphatic, heterocyclic, or carbocyclic radicals, and $X^-$ is an anion.

4. The material of claim 1 wherein said quaternary ammonium salt is represented by the following Structure (1):

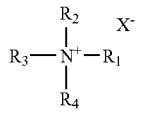

(I)

wherein any two or more of $R_1$, $R_2$, $R_3$, and $R_4$ can to be combined to form a quaternary ring with the nitrogen atom, and $X^-$ is an anion.

5. The material of claim 3 wherein $R_1$, $R_2$, $R_3$, and $R_4$ are independently hydrocarbon groups having 1 to 24 carbon atoms, or any two or more of said radicals can be combined to form a pyridinium, piperidinium, pyrazinium, imidazolium, or morpholinium ring with the nitrogen atom.

6. The material of claim 1 wherein said quaternary ammonium salt is one or more of tetramethylanimonium acetate, tetraethylammonium acetate, tetraoctylammonium fluoride, tetraethylammonium nitrate, tetramethylammonium formate, di-tetramethylammonium oxalate, tetraethylammonium 2,3-dihydroxybenzoate, tetraethylammonium cyanide, tetramethylammonium hydroxide, tetramethylammonium nitrate, tetra-n-butylanunonium acetate, tetrahexylammonium hydrogen sulfate, tetraethylammonium fluoride, 1-ethyl-4-(methoxycarbonyl)pyridinium iodide, 1-ethyl-3-methyl-1H-imidazolium trifluoromethanesulfonate, tetramethylammonium 6-bromohexanoate, tetraethylammonium bromide, tetraethylammonium behenate, and cetyltrimethylammonium hydrogen sulfate, said one or more quaternary ammonium salts being present in an amount 0.5 to about 40 mol % based on total silver in said material.

7. The material of claim 1 that is a non-light sensitive direct thermographic material.

8. The material of claim 1 that is a photothermographic material that further comprises a photosensitive silver halide.

9. The material of claim 1 wherein said non-photosensitive organic silver salt includes one or more silver aliphatic carboxylates including at least silver behenate.

10. The material of claim 1 comprising a total amount of silver of at least 0.002 mol/m$^2$.

11. The material of claim 1 further comprising a toning agent that is present in an amount of from about 0.01 to about 10% based on the total dry weight of the layer in which it is located.

12. The material of claim 1 that is duplitized, having one or more of the same or different thermally developable imaging layers on both sides of said support.

13. A black-and-white non-light sensitive direct thermographic material comprising a support having thereon at least one non-photosensitive thermally developable imaging layer comprising a binder, and further comprising, in reactive association:

a) a non-photosensitive source of reducible silver ions, b) a reducing agent for said reducible silver ions, and c) a quaternary ammonium salt that is present in an amount of from about 0.5 to about 100 mol % based on total silver in said material, provided that said quaternary ammonium salt is not a phthalazine or phthalazine derivative.

14. The material of claim 13 wherein said quaternary ammonium is present in an amount of from about 0.5 to about 40 mol % based on total silver in said material, said material has a total amount of silver of at least 0.002 mol/$m^2$, and said quaternary ammonium salt is represented by the following Structure (I):

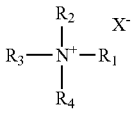

(I)

wherein $R_1$, $R_2$, $R_3$, and $R_4$ are independently aliphatic, heterocyclic, or carbocyclic radicals, or any two or more of said radicals can to be combined to form a quaternary ring with the nitrogen atom, and $X^-$ is an anion.

15. The material of claim 13 wherein said reducing agent is a mono-, di-, or trihydroxybenzene, said non-photosensitive organic silver salt includes one or more silver aliphatic carboxylates including at least silver behenate, and said material further comprises a toning agent that is present in an amount of from about 0.01 to about 10% based on the total dry weight of the layer in which it is located.

16. The material of claim 13 wherein said binder is a hydrophilic binder or a water-dispersible polymer latex, and said at least one non-photosensitive thermally developable, imaging layer is coated out of an aqueous solvent.

17. A black-and-white, non-photosensitive thermographic material that comprises a transparent polymer support having on only one side thereof, one or more thermally sensitive imaging layers and an outermost non-thermally sensitive protective layer over said one or more thermally sensitive imaging layers, said material comprising a total amount of silver of from about 0.002 to about 0.03 mol/$m^2$, said one or more thermally sensitive imaging layers comprising one or more hydrophobic binders, and in reactive association:

a) a non-photosensitive silver carboxylate salt comprising silver behenate, b) a reducing agent for said non-photosensitive source reducible silver ions comprising a dihydroxybenzene, c) a toning agent, and d) a quaternary ammonium salt that is present in an amount of from about 2 to about 20 mol % based on total silver in said material, said quaternary ammonium salt being one or more of tetramethylammonium acetate, tetraethylammonium acetate, tetraoctylammonium fluoride, tetraethylammonium nitrate, tetramethylammonium formate, di-tetramethylammonium oxalate, tetraethylammonium 2,3-dihydroxybenzoate, tetraethylammonium cyanide, tetramethylammonium hydroxide, tetramethylammonium nitrate, tetra-n-butylammonium acetate, tetrahexylammonium hydrogen sulfate, tetraethylammonium fluoride, 1-ethyl-4-(methoxycarbonyl)pyridinium iodide, 1-ethyl-3-methyl-1H-imidazolium trifluoromethanesulfonate, tetramethylammonium 6-bromohexanoate, tetraethylammonium bromide, tetraethylammonium behenate, and cetyltrimethylammonium hydrogen sulfate.

18. A black-and-white photothermographic material comprising a support having thereon at least one photosensitive thermally developable imaging layer comprising a binder, and further comprising, in reactive association:

a) a photosensitive silver halide, b) a non-photosensitive source of reducible silver ions, c) a reducing agent for said reducible silver ions, and d) a quaternary ammonium salt that is present in an amount of at least 0.5 mol % based on total silver in said material, provided that said quaternary ammonium salt is not a phthalazine or phthalazine derivative.

19. The material of claim 18 wherein said non-photosensitive source of reducible silver ions includes one or more silver aliphatic carboxylates including at least silver behenate.

20. The material of claim 18 wherein said at least one photosensitive thermally developable imaging layer comprises a hydrophilic or water-dispersible polymer binder and is coated out of an aqueous solvent.

21. The material of claim 20 wherein said non-photosensitive source of reducible silver ions includes one or more silver salts of a compound containing an imino group including at least silver benzotriazole, said reducing agent is as ascorbic acid derivative, and said silver halide comprises preformed tabular grains comprising silver bromide or silver iodobromide.

22. An image-forming method comprising:

A') imaging the thermally developable material of claim 1 that is a thermographic material with a thermal imaging source to provide a visible image, or A) imagewise exposing the thermally developable material of claim 1 that is a photothermographic material to form a latent image, and B) simultaneously or sequentially, heating said exposed photothermographic material to develop said latent image into a visible image.

23. The method of claim 22 wherein said imaging in step A' is carried out using a thin film thermal print head or a laser beam.

24. The method of claim 22 further comprising using said imaged thermographic material for medical diagnostic purposes.

* * * * *